US009893419B2

(12) United States Patent
Yosui et al.

(10) Patent No.: US 9,893,419 B2
(45) Date of Patent: Feb. 13, 2018

(54) ANTENNA DEVICE AND COMMUNICATION TERMINAL APPARATUS

(71) Applicant: Murata Manufacturing Co., Ltd., Nagaokakyo-shi, Kyoto-fu (JP)

(72) Inventors: Kuniaki Yosui, Nagaokakyo (JP); Naoki Gouchi, Nagaokakyo (JP); Naoto Ikeda, Nagaokakyo (JP); Hiroyuki Irikawa, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 226 days.

(21) Appl. No.: 14/604,940

(22) Filed: Jan. 26, 2015

(65) Prior Publication Data

US 2015/0138030 A1 May 21, 2015

Related U.S. Application Data

(63) Continuation of application No. PCT/JP2014/070366, filed on Aug. 1, 2014.

(30) Foreign Application Priority Data

Aug. 2, 2013 (JP) ..... 2013-161825
Dec. 4, 2013 (JP) ..... 2013-250844
(Continued)

(51) Int. Cl.
*H01Q 1/38* (2006.01)
*H01Q 7/00* (2006.01)
(Continued)

(52) U.S. Cl.
CPC ..... *H01Q 1/38* (2013.01); *H01Q 1/52* (2013.01); *H01Q 7/00* (2013.01); *H01Q 7/06* (2013.01)

(58) Field of Classification Search
CPC .. H01Q 1/38; H01Q 1/52; H01Q 7/00; H01Q 7/06
See application file for complete search history.

(56) References Cited

U.S. PATENT DOCUMENTS 7,289,069 B2 * 10/2007 Ranta ..... H01Q 1/243 343/700 MS
2001/0024739 A1 9/2001 Mizoguchi et al.
(Continued)

FOREIGN PATENT DOCUMENTS

JP 06-334289 A 12/1994
JP 2001-244123 A 9/2001
(Continued)

OTHER PUBLICATIONS

Official Communication issued in International Patent Application No. PCT/JP2014/070366, dated Sep. 2, 2014.
(Continued)

*Primary Examiner* — Hoang Nguyen
*Assistant Examiner* — Jae Kim
(74) *Attorney, Agent, or Firm* — Keating & Bennett, LLP

(57) ABSTRACT

An antenna device includes a first insulating base portion including a spiral antenna pattern, and a second insulating base portion including at least two conductor wires. An insulating layer configured to insulate the conductor wires from the antenna pattern is provided between a first end and a second end of the antenna pattern in a planar view. The insulating layer includes a cut or an opening allowing at least one of the first end and the second end of the antenna pattern to be exposed toward the conductor wires. Electrode portions of the conductor wires are electrically and mechanically connected to the first end and the second end, respectively, of the antenna pattern by a conductive material in the cut or the opening of the insulating layer. The second insulating base portion is more flexible than the first insulating base portion.

20 Claims, 28 Drawing Sheets

(30) Foreign Application Priority Data

Feb. 17, 2014 (JP) ..... 2014-027091
May 9, 2014 (JP) ..... 2014-097316

(51) Int. Cl.
*H01Q 7/06* (2006.01)
*H01Q 1/52* (2006.01)

(56) References Cited

U.S. PATENT DOCUMENTS

| | | | | |
|---|---|---|---|---|
| 2008/0047737 | A1 | 2/2008 | Sahara et al. | |
| 2010/0182144 | A1 | 7/2010 | Yamashita et al. | |
| 2012/0105362 | A1* | 5/2012 | Kremin | G06F 3/03545 345/174 |
| 2015/0077296 | A1* | 3/2015 | An | H01Q 1/22 343/720 |

FOREIGN PATENT DOCUMENTS

| | | | | | |
|---|---|---|---|---|---|
| JP | 2001-284759 | A | | 10/2001 | |
| JP | 2004-266811 | A | | 9/2004 | |
| JP | 2008-34588 | A | | 2/2008 | |
| JP | 2008-205557 | A | | 9/2008 | |
| JP | 4218635 | B2 | | 2/2009 | |
| JP | 2010-288242 | A | | 12/2010 | |
| JP | 2012-109406 | A | | 6/2012 | |
| JP | 2012-134656 | A | | 7/2012 | |
| JP | 2012203602 | A | * | 10/2012 | |
| JP | 2013-013144 | A | | 1/2013 | |
| WO | 2008/018413 | A1 | | 2/2008 | |
| WO | WO 2013/141658 | | * | 9/2013 | H01Q 1/22 |

OTHER PUBLICATIONS

Official Communication issued in corresponding Japanese Patent Application No. 2014-553560, dated Sep. 29, 2015.

* cited by examiner

ANTENNA DEVICE AND COMMUNICATION TERMINAL APPARATUS

BACKGROUND OF THE INVENTION

1. Field of the Invention

The present invention relates to an antenna device preferably for use in a non-contact communication system, for example, an NFC (near field communication) system, and a communication terminal apparatus including the antenna device.

2. Description of the Related Art

Recently, an antenna device for use in a non-contact communication system using a band of 13.56 MHz is incorporated in a portable terminal. In such an antenna device, as disclosed in Japanese Patent Laid-Open Publication No. 2013-13144, Japanese Patent Laid-Open Publication No. 2008-205557 and Japanese Patent No. 4218635, a coil pattern spiraling on a plane is used as an antenna.

In order to connect both ends of the coil pattern spiraling on a plane to other circuits, normally, either of the ends is led to the outside through a via-hole conductor because it is necessary to insulate the ends from each other. However, it takes time and labor to form a via-hole conductor in a substrate, and the formation of a via-hole conductor complicates a manufacturing process.

There is a demand for an antenna device that can avoid degradation of the antenna characteristics. More particularly, in a case where a magnetic member, which is a component of an antenna device, is a sintered body, prevention of cracks of the sintered body is demanded in order to prevent degradation of the antenna characteristics. Also, it is demanded that an antenna device keeps good antenna characteristics even when the antenna device is located at a shorter distance from a communication counterpart, for example, another antenna.

As for an antenna device, further, the following features are required. A magnetic field generated from an antenna pattern is prevented from propagating to other conductor wires. In a bending process, the conductor wires easily bend, and stress concentration is avoided. Wiring disconnection is avoided, and connection reliability is improved. The strength is improved.

SUMMARY OF THE INVENTION

Preferred embodiments of the present invention provide an antenna device that can be manufactured without formation of a via-hole conductor and that is wired simply for connection to an external device, and a communication terminal apparatus.

An antenna device according to a first aspect of various preferred embodiments of the present invention includes a first insulating base portion including a spiral antenna pattern including a first end and a second end; and a second insulating base portion including at least two conductor wires; wherein an insulating layer configured to insulate the conductor wires from the antenna pattern is provided between the first end and the second end of the antenna pattern in a planar view; the conductor wires include electrode portions electrically and mechanically connected to the first end and the second end, respectively, of the antenna pattern by a conductive material; the insulating layer includes a cut or an opening configured such that, before the conductor wires are connected to the antenna pattern, at least one of the first end and the second end of the antenna pattern is exposed toward the conductor wires through the cut or the opening; the conductor wires are connected to the antenna pattern by the conductive material in the cut or the opening of the insulating layer; and the second insulating base portion is more flexible than the first insulating base portion.

A communication terminal apparatus according to a second aspect of various preferred embodiments of the present invention includes the antenna device described above; and a printed wiring board including at least a noise filtering section and a matching section; wherein at least one of the conductor wires included in the second insulating base portion is connected to the noise filtering section or the matching section.

In the antenna device according to the first aspect of various preferred embodiments of the present invention, the first end and the second end of the antenna pattern included in the first insulating base portion are electrically and mechanically connected to the electrode portions of the conductor wires included in the second insulating base portion. Accordingly, it is possible to manufacture the antenna device without using via holes. Also, since the second insulating base portion has excellent flexibility, simple wiring is possible.

In such an antenna device, in order to prevent degradation of the antenna characteristics, it is preferred to inhibit a magnetic field generated by a coil pattern functioning as an antenna from being offset by lead wires. In a case where a sintered body of a magnetic material is located near the antenna, it is necessary to configure and arrange the sintered body in consideration of the possibility of breakage of the sintered body.

Thus, an antenna device that prevents degradation of the antenna characteristics by inhibiting a magnetic field generated by an antenna pattern from being offset by a magnetic field generated by lead wires is demanded.

Also, an antenna device that can diminish the risk of breakage of a sintered body of a magnetic material located near the antenna pattern, thus resulting in an improvement of the antenna characteristics, and significantly reduces or prevents breakage of the sintered body on the communication performance is demanded.

An antenna device according to a third aspect of various preferred embodiments of the present invention includes a first insulating base portion including a spiral antenna pattern including a first end and a second end; and a second insulating base portion including at least two conductor wires; wherein the two conductor wires are electrically connected to the first end and the second end, respectively of the antenna pattern; and in an outermost portion of the spiral antenna pattern and in one of the conductor wires closest to the outermost portion of the antenna pattern, currents flow in the same direction.

In such an antenna device, the outermost portion of the spiral antenna pattern is configured to determine the antenna characteristics to a great degree. In the antenna device according to the third aspect, since currents flow in the same direction in the outermost portion of the antenna pattern and in the one of the conductor wires located closest to the outermost portion of the antenna pattern, a magnetic field generated from the outermost portion of the antenna pattern is not offset by a magnetic field generated from the conductor wire closest thereto, and degradation of the antenna characteristics is prevented.

An antenna device according to a fourth aspect of outermost part the present invention includes a first insulating base portion including a spiral antenna pattern including a first end and a second end; a second insulating base portion including at least two conductor wires; and a magnetic member located between the first insulating base portion and the second insulating base portion; wherein the two conductor wires are electrically connected to the first end and the second end, respectively, of the antenna pattern; and in an outermost portion of the spiral antenna pattern and in one of the conductor wires closest to the outermost portion of the antenna pattern, currents flow in opposite directions.

In the antenna device according to the fourth aspect, since the magnetic member is located near the antenna pattern, the magnetic field around the antenna pattern is strengthened. Also, since currents flow in opposite directions in the outermost portion of the spiral antenna pattern and in one of the conductor wires closest to the outermost portion of the antenna pattern, there is no possibility that a magnetic field generated from the outermost portion of the antenna pattern and a magnetic field generated from the conductor wire closest thereto flow in the same direction inside the magnetic member, and degradation of the antenna characteristics is prevented.

An antenna device according to a fifth aspect of outermost part the present invention includes a first insulating base portion including a spiral antenna pattern including a first end and a second end; a second insulating base portion including at least two conductor wires; and a magnetic member located between the first insulating base portion and the second insulating base portion; wherein the two conductor wires are electrically connected to the first end and the second end, respectively, of the antenna pattern; the magnetic member includes a sintered body of a magnetic material and a supporting sheet stuck on the sintered body of the magnetic material, the sintered body being located on a side of the first insulating base portion, and the supporting sheet being located on a side of the second insulating base portion.

In the antenna device according to the fifth aspect, since the supporting sheet is stuck on the sintered body of the magnetic material, the sintered body does not break easily. Since the sintered body is located on a side of the first insulating base portion (that is, located on a side of the antenna pattern), the magnetic flux density of the antenna pattern is increased, and the antenna characteristics are improved.

An antenna device according to a sixth aspect of various preferred embodiments of the present invention includes a first insulating base portion including a spiral antenna pattern including a first end and a second end; a second insulating base portion including at least two conductor wires; and a sintered body of a magnetic material located between the first insulating base portion and the second insulating base portion; wherein the two conductor wires are electrically connected to the first end and the second end, respectively, of the antenna pattern; slits are provided in the sintered body in a matrix such that in an area near the antenna pattern, and the slits extend parallel or substantially parallel to the direction of a magnetic flux generated from the antenna pattern.

In the antenna device according to the sixth aspect, in consideration of the fragility of the sintered body of the magnetic material, slits are preliminarily made in the sintered body. In an area near the antenna pattern, the slits extend parallel or substantially parallel to the direction of a magnetic flux generated from the antenna pattern. Therefore, the slits do not block the magnetic field generated from the antenna pattern, and a reduction in the magnetic permeability is prevented.

An antenna device according to a seventh aspect of various preferred embodiments of the present invention includes a first insulating base portion including a spiral antenna pattern including a first end and a second end; a second insulating base portion including at least two conductor wires; and a sintered body of a magnetic material located between the first insulating base portion and the second insulating base portion; wherein the two conductor wires are electrically connected to the first end and the second end, respectively, of the antenna pattern; and slits are provided in the sintered body in a matrix except for an area near the antenna pattern.

In a case where a sintered body is stuck on the first insulating base portion, it is likely that the widths of the slits may change, which results in a change in the permeability. In the antenna device according to the seventh aspect, in the area near the antenna pattern, the slits in a matrix are not provided. Therefore, in the area near the antenna pattern, it is unlikely that the widths of the slits change, and a reduction in the permeability is prevented.

An antenna device according to an eighth aspect of various preferred embodiments of the present invention includes a first insulating base portion including a spiral antenna pattern; and a second insulating base portion including at least two conductor wires, each of the conductor wires including a first end connected to the antenna pattern and a second end connected to an external connection terminal; wherein, when viewed along an axis of a spiral of the antenna pattern, the conductor wires overlap with the antenna pattern; and in the overlapping portion of the antenna pattern and the conductor wires, a magnetic sheet is provided between the antenna pattern and the conductor wires.

In the antenna device according to the eighth aspect, since the magnetic sheet is provided between the antenna pattern and the conductor wires, a magnetic field generated by the antenna pattern is prevented from propagating to the conductor wires, and degradation of the antenna characteristics is prevented. It is preferred that the magnetic sheet covers the coil open portion of the antenna pattern. Also, it is preferred that the second insulating base portion is located within the outer edge of the first insulating base portion when viewed along the axis of spiral of the antenna pattern. Accordingly, the antenna device is capable of being significantly reduced in size.

Further, it is preferred that the portion of the second antenna insulating base portion where the conductor wires are connected to the antenna pattern is thinner than the portion of the second antenna insulating base portion where the external connection terminals are provided. The thinner portion is more flexible and bends more easily, and breakage of the conductor wires is reliably prevented. Also, the second insulating base portion is preferably a laminate of insulating base plates, and the conductor wires are preferably located between the insulating base plates. In the structure, the conductor wires are protected effectively, and the conductor wires are prevented from coming off from the insulating base plates.

Further, the second insulating base portion is preferably thinner than the first insulating base portion. The first insulating base portion preferably includes a magnetic sheet and a first insulating base including an antenna pattern thereon, and the first insulating base is preferably thinner than the second insulating base portion. Thus, the second insulating base portion is more flexible than the first insulating base portion, and bending of the second insulating base portion is easy. By reducing the thickness of the first insulating base, on which the antenna pattern is provided, the distance between the antenna pattern and a communication counterpart, for example, an antenna, becomes shorter, and the communication performance is improved.

An antenna device according to a ninth aspect of various preferred embodiments of the present invention includes a first insulating base portion including a spiral antenna pattern; and a second insulating base portion including at least two conductor wires, each of the conductor wires including a first end connected to the antenna pattern and a second end connected to an external connection terminal; wherein the first insulating base portion includes a first insulating base on which the antenna pattern is provided; and the first insulating base is thinner than the second insulating base portion.

In the antenna device according to the ninth aspect, since the first insulating base is thinner than the second insulating base portion, the distance between the antenna pattern and a communication counterpart, for example, an antenna is short. Accordingly, the antenna device has improved communication performance. The flexible first insulating base follows the shape of an article to which the antenna device (first insulating base) is stuck, for example, a case. Further, the risk of displacement and/or breakage of the conductor wires is eliminated.

The second insulating base portion preferably includes a second insulating base including the conductor wires thereon, and the first insulating base and the second insulating base are preferably made of the same material. In a case where the first insulating base and the second insulating base are made of the same material, it is unlikely that stress due to the difference in coefficient of thermal expansion occurs on the connection portion between the first insulating base and the second insulating base. It is preferred that a magnetic sheet is stuck on the first insulating base except for connection portions between the antenna pattern and the respective conductor wires. The magnetic sheet is preferably arranged such that the antenna pattern is sandwiched between the magnetic sheet and the first insulating base. The provision of the magnetic sheet results in effective protection of the antenna pattern.

It is preferred that the line widths of at least the portions of the conductor wires connected to the antenna pattern are greater than the line width of the antenna pattern. With this arrangement, wire disconnection is unlikely to occur on the connection portions between the antenna pattern and the respective conductor wires, and the connection reliability is improved.

In an antenna device according to a tenth aspect, the external connection terminals of the conductor wires are drawn to a front surface and/or a back surface of the second insulating base portion through interlayer connection conductors. By applying a heating member, for example, a heater bar to the external connection terminals drawn to either the front surface or the back surface of the second insulating base portion, the external connection terminals located on the opposite side of the second insulating base portion are connected to lands on a printed wiring board. Alternatively, by applying a heating member to the external connection terminals exposed on either the front surface or the back surface of the second insulating base portion, the external connection terminals exposed on the opposite side of the second insulating base portion are connected to lands on a printed wiring board.

According to various preferred embodiments of the present invention, it is possible to manufacture an antenna device without forming a via-hole conductor, and the antenna device has simple wiring for connection to an external device.

According to various preferred embodiments of the present invention, also, a magnetic member hardly breaks, and even if the magnetic material breaks, the breakage has no effects or only negligible effects on the antenna characteristics.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
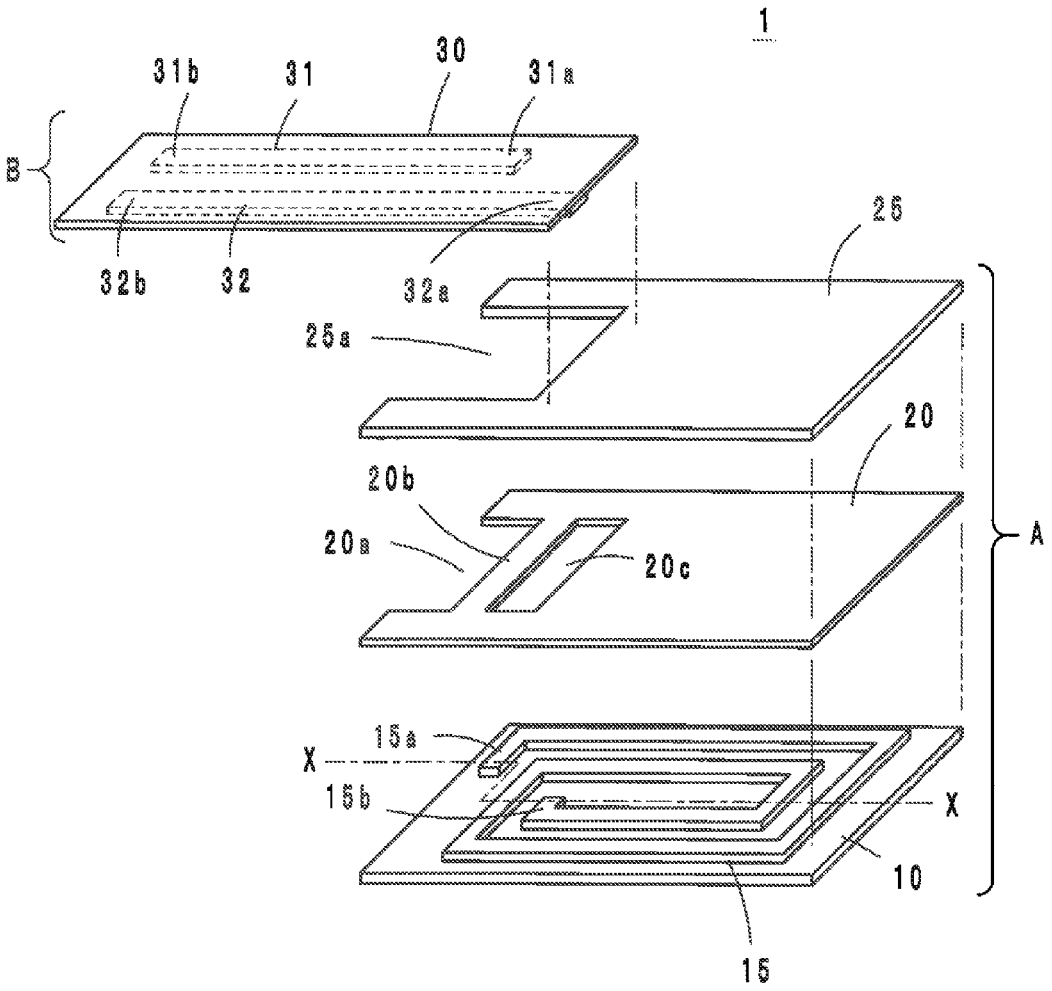
FIG. 1 is an exploded view of an antenna device according to a first preferred embodiment of the present invention.

Antenna devices and communication terminal apparatuses according to some preferred embodiments of the present invention are hereinafter described with reference to the drawings. In the drawings, the same components and elements are identified with the same reference symbols, and descriptions of the same components and elements are not repeated.

First Preferred Embodiment

An antenna device 1 according to a first preferred embodiment of the present invention illustrated in FIG. 1 is preferably for use in an NFC system of an HF band, an RFID system or the like, for example. The antenna device 1 preferably includes a first insulating base portion A and a second insulating base portion B. The first insulating base portion A includes a first insulating base 10, an antenna pattern 15, an insulating adhesive layer 20, and a ferrite sheet 25. The antenna pattern 15 is configured to spiral on a main surface of the first insulating base 10 with its first end 15*a* and its second end 15*b* located on the main surface. The ferrite sheet 25 is a magnetic sheet. The second insulating base portion B includes a second insulating base 30, and conductor wires 31 and 32 on a back surface of the second insulating base 30.

The conductor wire 31 includes an electrode portion 31*a* and an external connection terminal 31*b*. The electrode portion 31*a* of the conductor wire 31 is soldered (electrically and mechanically connected) to the first end 15*a* of the antenna pattern 15 on a planar surface. The conductor wire 32 includes an electrode portion 32*a* and an external connection terminal 32*b*. The electrode portion 32*a* of the conductor wire 32 is soldered (electrically and mechanically connected) to the second end 15*b* of the antenna pattern 15 on a planar surface.

The first insulating base 10 and the second insulating base 30 are preferably made of polyimide resin. However, any other material, for example, liquid crystal polymer or the like may be used for the bases 10 and 30. In a planar view, the second insulating base 30 is elongated and protrudes outward from the first insulating base 10. The second insulating base portion B is more flexible than the first insulating base portion A. In a case where the first insulating base 10 and the second insulating base 30 are made of the same material, stress due to a difference in coefficient of thermal expansion is unlikely to occur at the connection portion between the bases 10 and 30.

The antenna pattern 15, and the conductor wires 31 and 32 are formed preferably by etching copper foils formed on the bases 10 and 30, respectively. However, any other method may be used to form the antenna pattern 15, and the conductor wires 31 and 32.

The insulating adhesive layer 20 is configured to insulate the antenna pattern 15 from the conductor wire 32, which crosses the antenna pattern 15 in a planar view, so as to prevent short circuiting. The insulating adhesive layer 20 preferably is preliminarily formed by pattern printing on the first insulating base 10, on which the antenna pattern 15 is formed, or on the back surface of the second insulating base 30, on which the conductor wires 31 and 32 are formed. Alternatively, the insulating adhesive layer 20 may be an adhesive sheet stuck on the insulating base 10 or 30. The insulating adhesive layer 20 is also used to bond the ferrite sheet 25 to the first insulating base 10.

The second insulating base 30 is bonded onto the first insulating base 10 via the insulating adhesive layer 20. Then, the first end 15*a* and the second end 15*b* of the antenna pattern 15 are soldered to the electrode portion 31*a* of the conductor wire 31 and to the electrode portion 32*a* of the conductor wire 32, respectively, through cuts 20*a* and 20*c* made in the insulating adhesive layer 20 and a cut 25 made in the ferrite sheet 25 (see solder 40 in FIGS. 2A and 2B). The insulating adhesive layer 20 includes a bridge 20*b* in the cut 20*a* so as to insulate the electrode portions 31*a* and 32*a* from each other.

The insulating adhesive layer 20 including the cuts 20*a* and 20*c* preferably are formed by pattern printing, for example. Alternatively, an adhesive sheet with the cuts 20*a* and 20*c* preliminarily made therein may be used as the insulating adhesive layer 20. During a heating process such as a reflow soldering process, the insulating adhesive sheet 20 is slightly pressed to be bonded onto the first insulating base 10. The insulating adhesive layer 20 flows due to the heat. In this moment, the bridge 20*b* for insulation flows to cover a portion of the antenna pattern 15 and to come into a space between the first end 15*a* and the second end 15*b* of the antenna pattern 15, in a planar view, on the first insulating base 10. Due to the bridge 20*b*, a short circuit of the antenna pattern 15 by the conductor wire 32 is prevented.

In the antenna device 1 having the structure above, the first and the second ends 15*a* and 15*b* of the antenna pattern 15 provided on the main surface of the first insulating base 10 are electrically and mechanically connected to the electrode portions 31*a* and 32*a* of the conductor wires 31 and 32, respectively, on a planar surface. Therefore, it is not necessary to use via-hole conductors, and it is easy to manufacture the antenna device 1. Although the second insulating base portion B protrudes from the first insulating base portion A, only simple wiring is required because the second insulating base portion B has an excellent flexibility.

The cut 25*a* of the ferrite sheet 25 allows a bond of the first insulating base 10 and the second insulating base 30 to each other. Specifically, through the cut 25*a* of the ferrite sheet 25 and the cuts 20*a* and 20*c* of the insulating adhesive layer 20, the first and the second ends 15*a* and 15*b* of the antenna pattern 15 are exposed to outside. The ferrite sheet 25 prevents leakage of a magnetic field generated from the antenna pattern 15 and strengthens magnetic coupling so that external magnetic waves and high-frequency signals are suitably input to the antenna pattern 15. Especially both sides of the cut 25*a* of the ferrite sheet 25 prevent leakage of the magnetic field radiated from the antenna pattern 15.

When a metal object is put close to the antenna pattern 15, an eddy current occurs on the metal object due to the magnetic field radiated from the antenna pattern 15, and thus, the energy of the antenna pattern 15 may be weakened. According to this preferred embodiment, however, the provision of the ferrite sheet 25 significantly reduces or prevents such an energy loss. This effect of reducing the energy loss is made stronger by adding a magnetic material, for example, a magnetic powder to the material of the insulating adhesive layer 20.

Figure 2A:
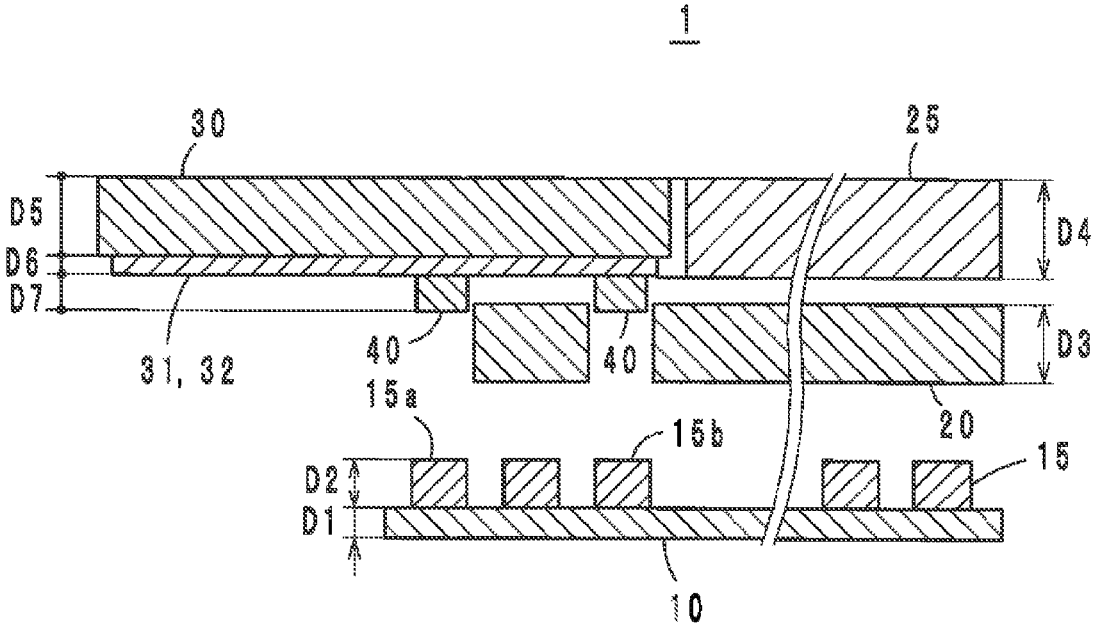
FIGS. 2A and 2B are sectional views of the antenna device, FIG. 2A illustrating the antenna device in a disassembled state, and FIG. 2B illustrating the antenna device in an assembled state.
Figure 2B:
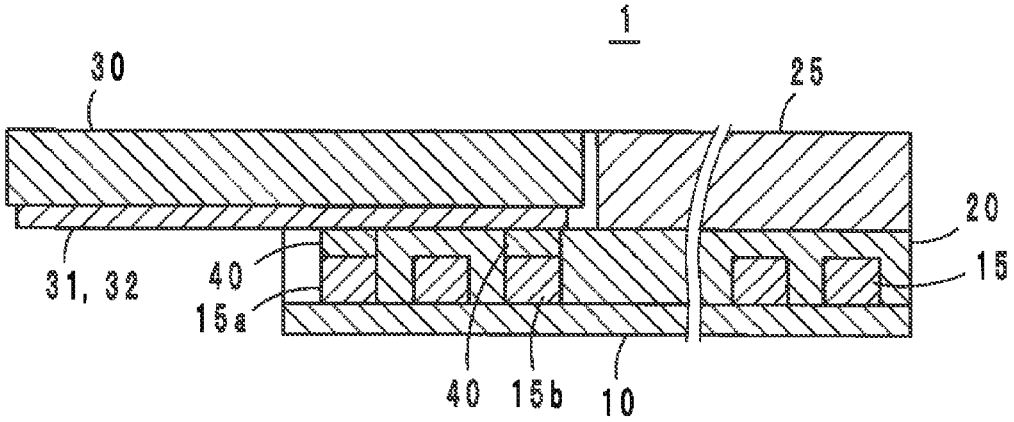

Exemplary materials and thicknesses of the components of the antenna device 1 are described with reference to FIGS. 2A and 2B. FIGS. 2A and 2B are sectional views of the antenna device 1 along the line X-X indicated in FIG. 1, and illustrates the relation of connection in an easy-to-understand manner. The sectional views illustrated in FIGS. 2 through 11 are along the same line.

The first insulating base 10 preferably is made of polyimide resin, and the thickness D1 thereof is preferably within a range from about 10 μm to about 15 μm, for example. The antenna pattern 15 preferably is made of a copper foil, and the thickness D2 thereof preferably is within a range from about 15 μm to about 35 μm, for example. The insulating adhesive layer 20 is preferably made of epoxy resin, and the thickness D3 thereof is preferably within a range from about 25 μm to about 45 μm, for example. The ferrite sheet 25 preferably is a sintered body of a Ni—Zn-based material, and the thickness D4 thereof preferably is within a range from about 100 μm to about 150 μm, for example. The second insulating base 30 is preferably made of polyimide resin, and the thickness D5 thereof preferably is within a range from about 50 μm to about 100 μm, for example. The conductor wires 31 and 32 are preferably made of a copper foil, and the thickness D6 thereof preferably is within a range from about 10 μm to about 20 μm, for example. The solder 40 is preliminarily coated on the conductor wires 31 and 32, and the thickness D7 thereof preferably is within a range from about 10 μm to about 30 μm, for example.

More specifically, in this preferred embodiment, the thicknesses D1 through D7 preferably are as follows. The thickness D1 of the first insulating base 10 preferably is about 10 μm, and the thickness D2 of the antenna pattern 15 preferably is about 20 μm, for example. The thickness D3 of the insulating adhesive layer 20 preferably is about 30 μm, and the thickness D4 of the ferrite sheet 25 preferably is about 120 μm, for example. The thickness D5 of the second insulating base 30 preferably is about 100 μm, and the thicknesses of the conductor wires 31 and 32 are about 16 μm, for example. The thickness D7 of the solder 40 preferably is about 10 μm, for example. In the structure having the thicknesses, the second insulating base portion B is more flexible than the first insulating base portion A. The thicknesses of the components seen in the sectional views in FIGS. 2A, 2B and 3 are not necessarily consistent with the values above.

It is preferred that the thickness D3 of the insulating adhesive layer 20 is smaller than the thickness D4 of the ferrite sheet 25. When the thickness D3 of the insulating adhesive layer 20 is small, it is easy to bond the conductor wires 31 and 32 to the pattern 15 by the solder 40 with the insulating adhesive layer 20 held between. Also, it is preferred that the thickness D3 of the insulating adhesive layer 20 is greater than the thickness D2 of the antenna pattern 15. With this arrangement, an undesired electrical connection (short circuit) between the antenna pattern 15 and the conductor wire 31 or 32 is prevented.

It is preferred that the thickness D1 of the first insulating base 10 is smaller than the thickness D2 of the antenna pattern 15. With this arrangement, it is possible to reduce the thickness of the antenna device 1 as a whole while reducing the conductor loss.

Figure 3:
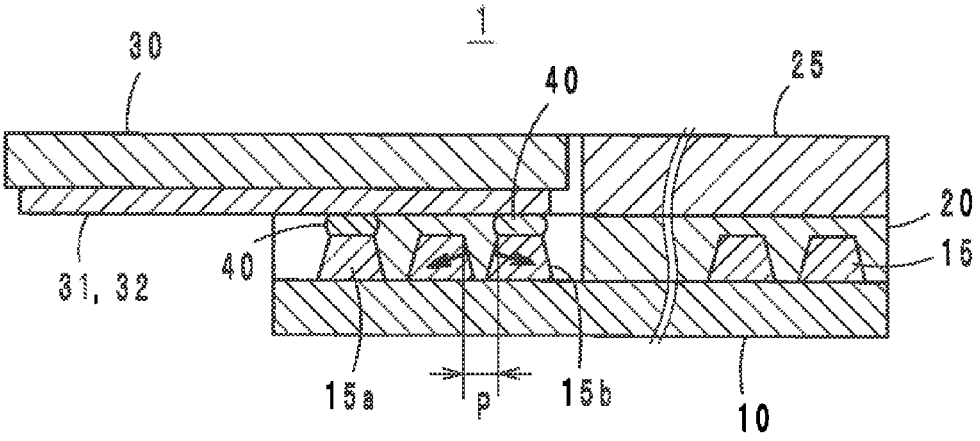
FIG. 3 is a sectional view indicating another shape of an antenna pattern.

As seen in FIG. 3, a cross section (a section cut in the widthwise direction) of the antenna pattern 15 preferably has a trapezoidal shape with a greater lower base and a smaller upper base. Reflow soldering by use of the solder 40 is carried out while the first insulating base portion A and the second insulating base portion B are pressed in the thickness direction with the insulating adhesive layer 20 placed between the portions A and B. In this moment, the pressure of the flowing insulating adhesive layer 20 acts on the pattern 15 in the directions indicated by arrows in FIG. 3. If the cross-sectional shape of the pattern 15 is rectangular, the pattern 15 will block the flow of the adhesive layer 20, and the pressure of the flowing adhesive layer 20 will act strongly on the pattern 15, such that the pattern 15 may come off from the first insulating base 10.

In a case where the cross-sectional shape of the antenna pattern 15 is trapezoidal, the pitch P of the upper surface of the spiral antenna pattern 15 is wider. Thus, the fluidity of the adhesive layer 20 becomes greater, and the pressure applied on the pattern 15 is weakened. Accordingly, it is unlikely that the pattern 15 comes off from the first insulating base 10. The greater fluidity of the adhesive layer 20 results in good connection by the solder 40. In order to prevent detachment of the pattern 15 from the first insulating base 10 due to the pressure of the flowing adhesive layer 20, it is also possible to increase the surface roughness of the surface of the antenna pattern 15 in contact with the first insulating base 10 (that is, the lower surface of the antenna pattern 15). The increase in the surface roughness of the surface of the antenna pattern 15 in contact with the first insulating base 10 increases the joint strength between the base 10 and the pattern 15. The increase in the pitch P of the upper surface of the antenna pattern 15 causes an increase in the conductor spacing, and this reduces energy loss caused by line capacity.

It is possible to form the antenna pattern 15 into a trapezoidal cross-sectional shape, for example, by adjusting the etching speed during an etching process to form the antenna pattern 15.

Figure 4:
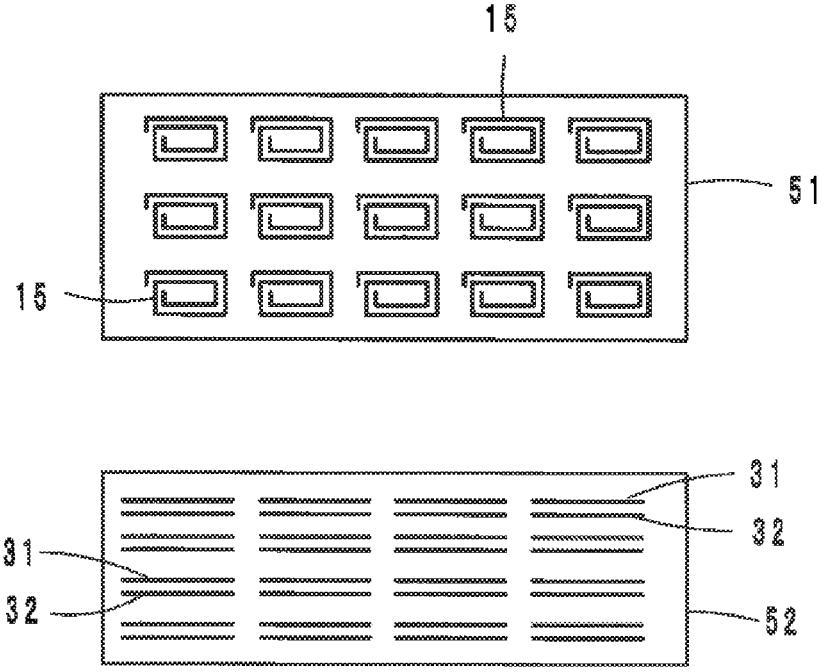
FIG. 4 is a plan view illustrating a step of a manufacturing process of the antenna device.

A non-limiting example of a method of manufacturing will now be described. First, as illustrated in FIG. 4, antenna patterns 15 are formed in a matrix on a large mother sheet 51, and pairs of conductor wires 31 and 32 are formed in a matrix on a large mother sheet 52. The mother sheet 51 is cut into a plurality of first insulating bases 10 such that each of the first insulating bases 10 includes an antenna pattern 15, and the mother sheet 52 is cut into a plurality of second insulating bases 30 such that each of the second insulating bases 20 includes a pair of conductor wires 31 and 32. Each one of the bases 30 is laminated and bonded to each one of the bases 10 via the insulating adhesive layer 20 with the cuts 20*a* and 20*c* made therein and the ferrite sheet 25 with the cut 25*a* made therein. In this way, a large number of bases 10 and a large number of bases 30 can be obtained at one time.

Figure 5:
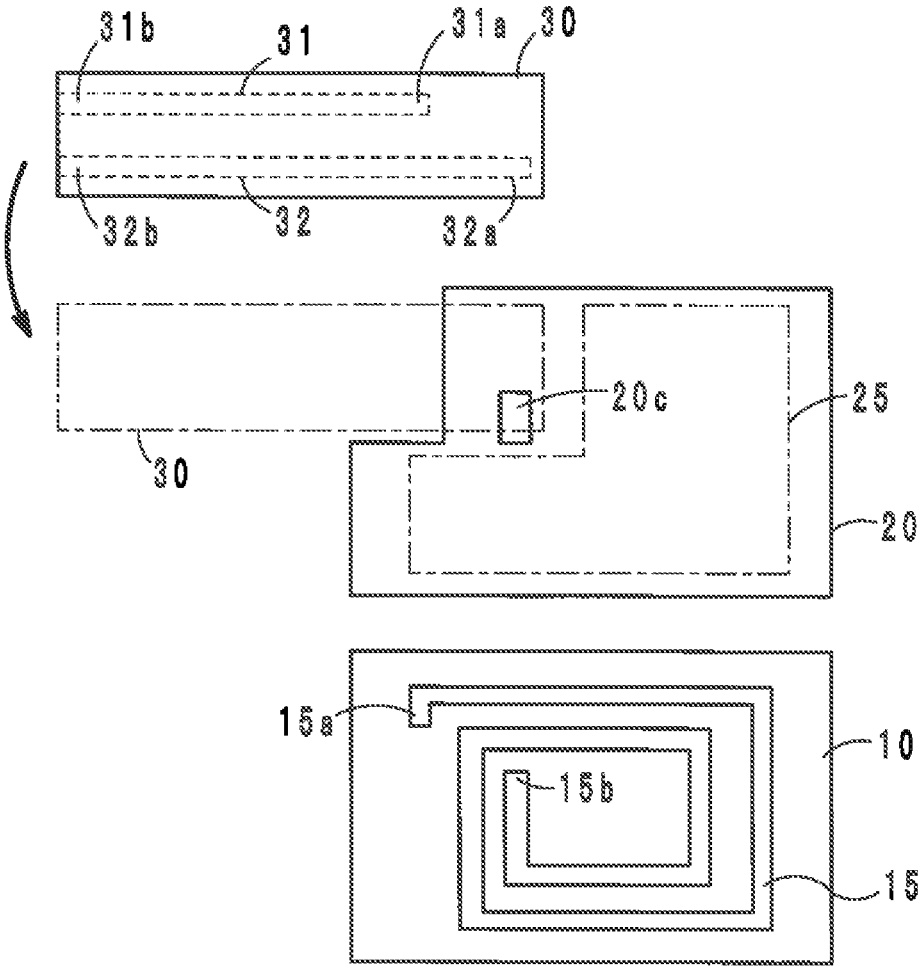
FIG. 5 is a plan view illustrating another connection form between the antenna pattern and a conductor wire.
Figure 6:
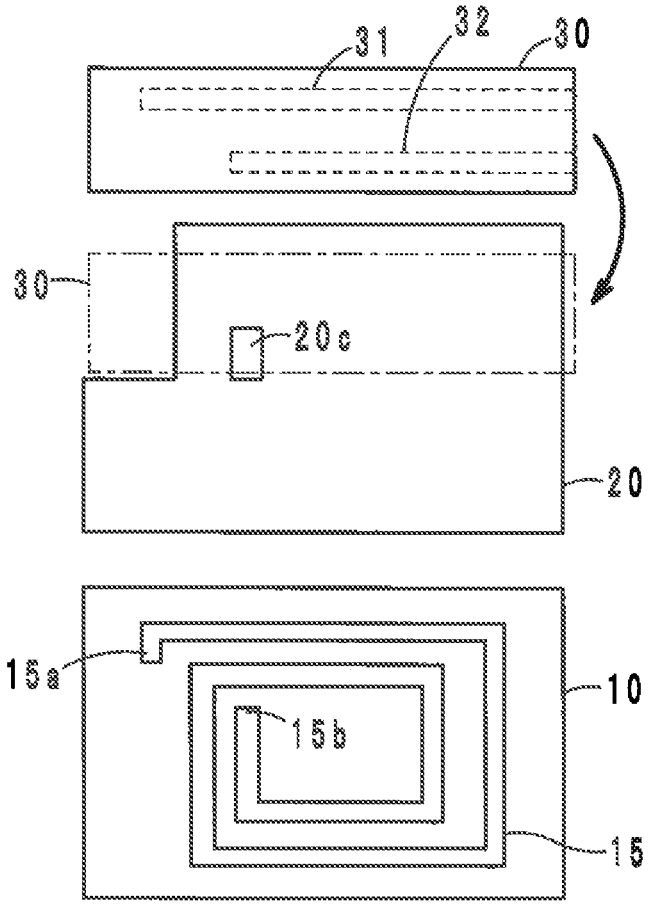
FIG. 6 is a plan view illustrating still another form of connecting the antenna pattern to a conductor wire.

The antenna pattern 15 may be connected to the conductor wires 31 and 32 as illustrated in FIG. 5. Specifically, the second insulating base 30 may be located on a corner portion of the first insulating base 10. Also, it is possible to connect the antenna pattern 15 to the conductor wires 31 and 32 as illustrated in FIG. 6. Specifically, the second insulating base 30 may be located on the upper half in FIG. 6 of the first insulating base 10 such that the second insulating base 30 will not protrude outward from the first insulating base 10.

In either of the connection configurations illustrated in FIGS. 5 and 6, electrical and mechanical connections on a planar surface between the first end 15*a* of the antenna pattern 15 and the electrode portion 31*a* of the conductor wire 31 and between the second end 15*b* of the antenna pattern 15 and the electrode portion 32*a* of the conductor wire 32 are attained without causing a short circuit.

Figure 7:
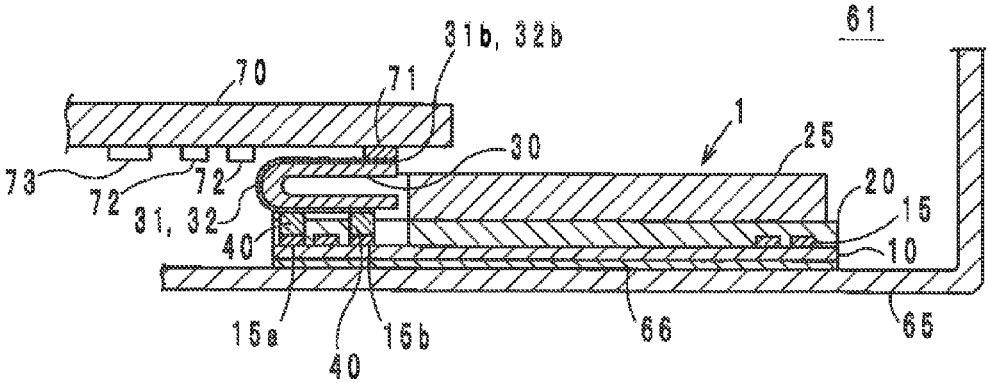
FIG. 7 is a plan view of a communication terminal apparatus illustrating a first exemplary form of incorporation of the antenna device in the communication terminal device.

Referring to FIG. 7, a first exemplary communication terminal apparatus 61 including the antenna device 1 is described. The communication terminal apparatus 61 is, for example, a cell phone, and the antenna device 1 is stuck to the bottom of a case 65 via an adhesive layer 66. The second insulating base 30 is folded back 180 degrees, and the terminals 31*b* and 32*b* of the conductor wires 31 and 32 are electrically connected via solder 71 to a matching element (capacitor) 72 mounted on a printed wiring board 70. Further, a noise filter 73 and other elements are mounted on the printed wiring board 70.

Figure 8:
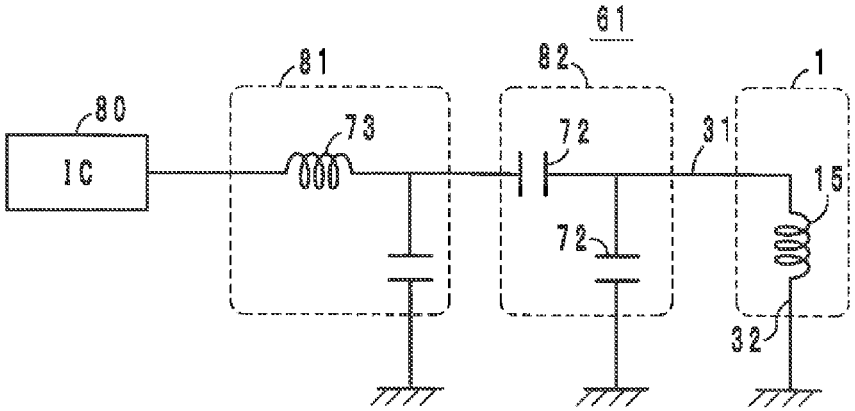
FIG. 8 is a circuit diagram of a portion of the communication terminal device.

As illustrated in FIG. 8, a circuit in the connection portion of the communication terminal apparatus 61 includes a noise filter section 81 connected to an IC 80, and a matching section 82. The antenna device 1 is connected to the matching section 82. The conductor wire 31 is used for connection to the matching section 82, and the conductor wire 32 is used for connection to a ground.

Second Preferred Embodiment

Figure 9:
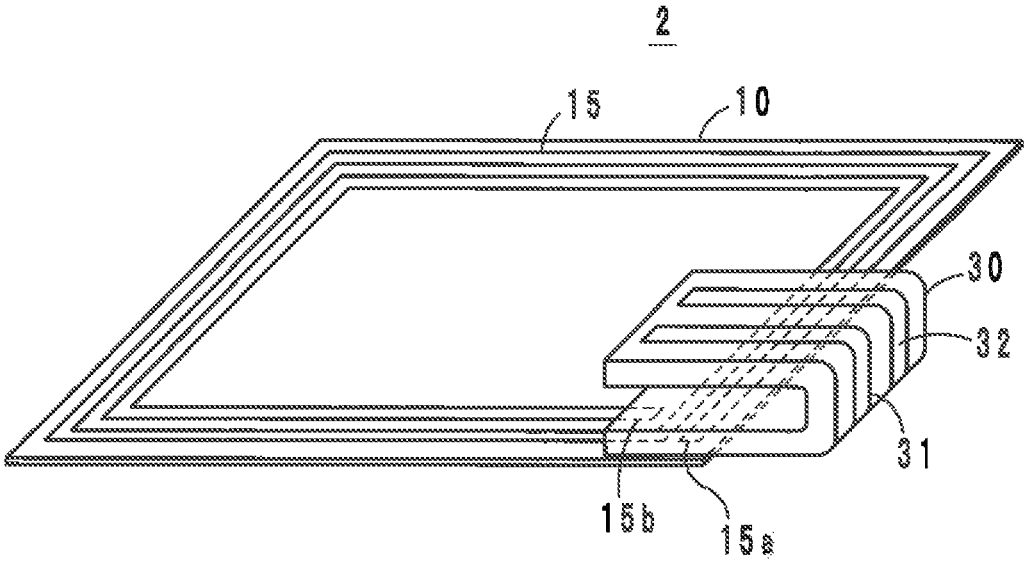
FIG. 9 is a perspective view of an antenna device according to a second preferred embodiment of the present invention.

As illustrated in FIG. 9, in an antenna device 2 according to a second preferred embodiment of the present invention, the second insulating base 30 is relatively thick and plastic, and is folded back by plastic deformation at or substantially at the center. The antenna device 2 is connected to a printed wiring board in a communication terminal apparatus in a similar manner as illustrated in FIG. 7 although the connection between the antenna device 2 and the printed wiring board is not illustrated in the drawings.

Figure 10:
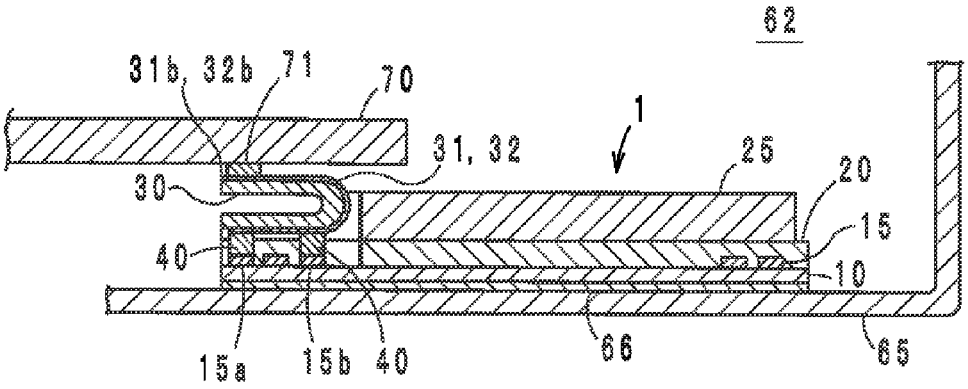
FIG. 10 is a plan view of a communication terminal apparatus illustrating a second exemplary form of incorporation of the antenna device in the communication terminal device.

In a second exemplary communication terminal apparatus 62, the antenna device 1 has the first and the second insulating bases 10 and 30 connected to each other in the configuration illustrated in FIG. 6. As illustrated in FIG. 10, in the second exemplary communication terminal apparatus 62, the second insulating base 30 is folded back immediately above the first insulating base 10, and the terminals 31*b* and 32*b* of the conductor wires 31 and 32 are connected via solder 71 to a matching element on a printed wiring board 70. In this example, the folded-back second insulating base 30 does not protrude from the outside edge of the first insulating base 10, and the antenna device 1 is smaller.

Figure 11:
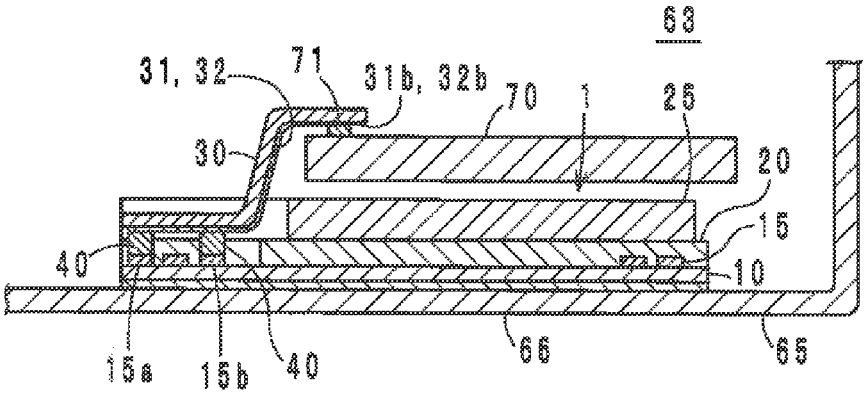
FIG. 11 is a plan view of a communication terminal apparatus illustrating a third exemplary form of incorporation of the antenna device in the communication terminal device.

In a third exemplary communication terminal apparatus 63, the antenna device 1 has the first and the second insulating bases 10 and 30 connected to each other in the configuration illustrated in FIG. 6. In the communication terminal apparatus 63, as illustrated in FIG. 11, the end portion of the second insulating base 30 where the terminals 31*b* and 32*b* of the conductor wires 31 and 32 are located is lifted up, and the terminals 31*b* and 32*b* of the conductor wires 31 and 32 are connected via solder 71 to an upper surface of the printed wiring board 70 so as to be connected to a matching element mounted on the printed wiring board 70. The printed wiring board 70 is supported by a support member (not indicated in the drawings) and is maintained in a position to overlap with the first insulating base 10 in a planar view.

Third Preferred Embodiment

Figure 12:
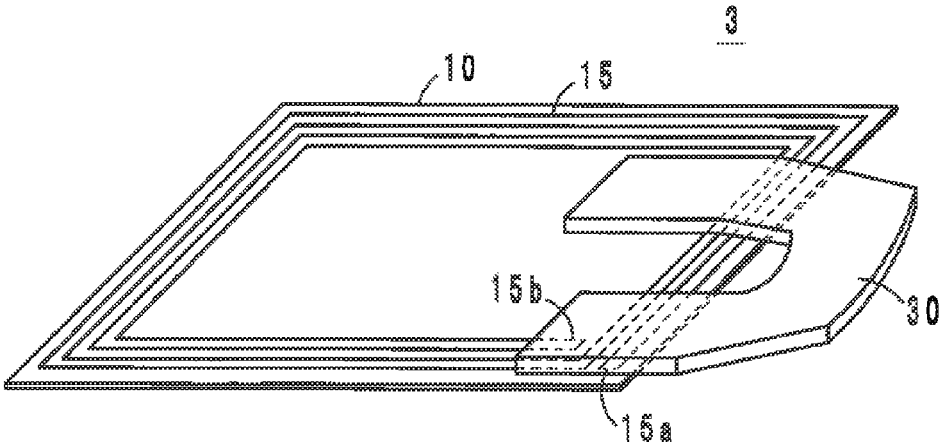
FIG. 12 is a perspective view of an antenna device according to a third preferred embodiment of the present invention.

As illustrated in FIG. 12, in an antenna device 3 according to a third preferred embodiment of the present invention, the second insulating base 30 is bifurcated, and the end portion of the second insulating base 30 where the terminals 31*b* and 32*b* of the conductor wires 31 and 32 are located is slightly lifted up. (The conductor wires 31 and 32 are not seen in FIG. 12 because the conductor wires 31 and 32 are provided on the back surface of the second insulating base 30.) The conductor wires 31 and 32 are connected to a printed wiring board in a similar manner as illustrated in FIG. 11.

Fourth Preferred Embodiment

Figure 13:
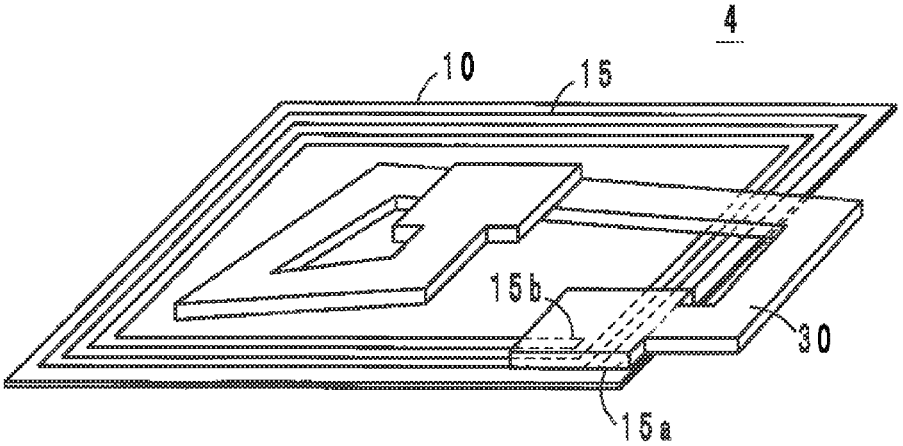
FIG. 13 is a perspective view of an antenna device according to a fourth preferred embodiment of the present invention.

As illustrated in FIG. 13, in an antenna device 4 according to a fourth preferred embodiment of the present invention, the second insulating base 30 is folded at a plurality of points so as to include a coil-shaped portion, and the coil-shaped portion is gradually lifted up. In this antenna device 4, the second insulating base 30 has high elastic deformability in the thickness direction. Accordingly, stress concentration on the connection portions where the respective electrode portions 31*a* and 31*b* of the conductor wires 31 and 32 are connected to the antenna pattern 15 is effectively prevented, and the second insulating base 30 is hard to break. The same holds true for the antenna device 3.

Some examples of reinforcement of the connection portions between the conductor wire 31 and the antenna pattern 15 and between the conductor wire 32 and the antenna pattern 15 will be described below.

Figure 14A:
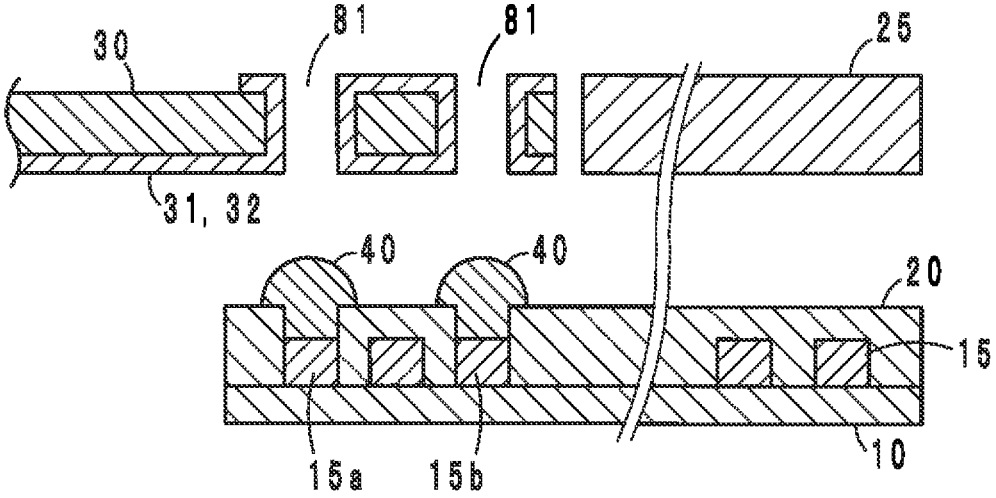
FIGS. 14A and 14B are sectional views of an antenna device, illustrating a first example of reinforcement of connection portions.
Figure 14B:
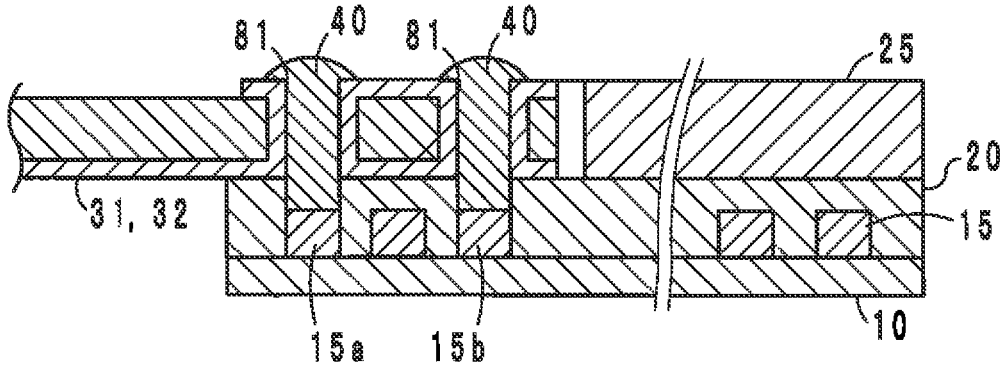
Figure 15A:
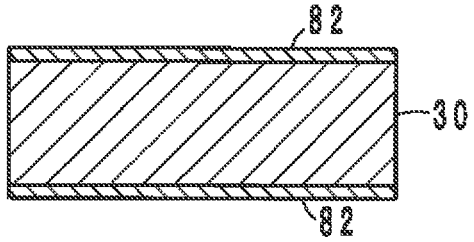
FIGS. 15A through 15D illustrate a process of forming a though hole.
Figure 15B:
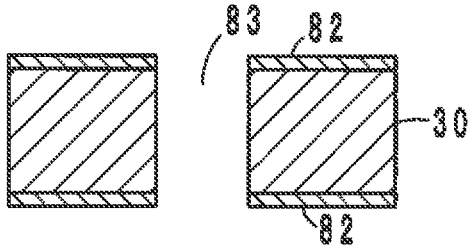
Figure 15C:
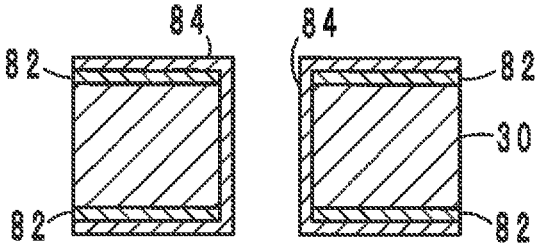
Figure 15D:
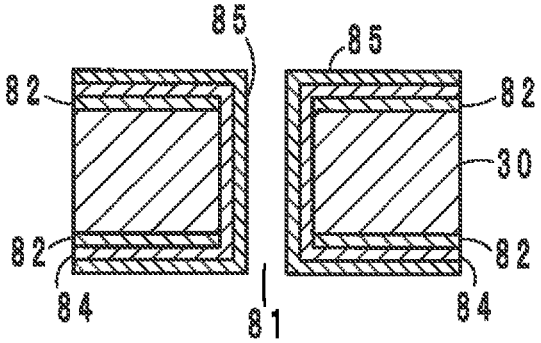

As illustrated in FIG. 14A, through holes 81 are made in the second insulating base 30, at the locations of the conductor wires 31 and 32. Thus, as illustrated in FIG. 14B, solder 40 is filled up in the through holes 81. Consequently, the connection portions between the conductor wire 31 and the antenna pattern 15 and between the conductor wire 32 and the antenna pattern 15 are reinforced.

The through holes 81 can be formed, for example, by a process as illustrated in FIGS. 15A through 15D. Metal films are formed on the upper surface and the lower surface of the base 30 (see FIG. 15A), and holes 83 are made (see FIG. 15B). Next, the inner surfaces of the holes 83 and the metal films 82 are coated with films 84 by electroless plating (see FIG. 15C). Further, the films 84 are coated with films 85 by electrolytic plating (see FIG. 15D).

The through holes 81 do not always need to have conductors (films 84 and 85) on their respective inner surfaces, and it may be sufficient to only form holes 83. In other words, as long as melted solder 40 can be filled up in the holes 83, it is not necessary to form conductors on the respective inner surfaces of the holes 83.

Figure 16:
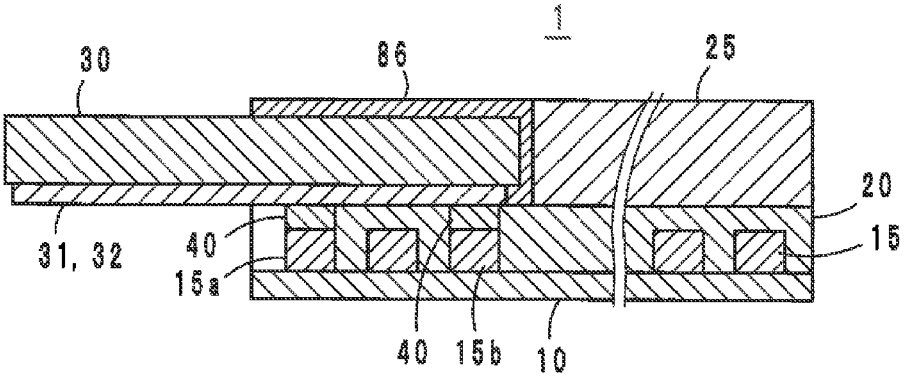
FIG. 16 is a sectional view of the antenna device, illustrating a second example of reinforcement of connection portions.

In a second example of reinforcement, as illustrated in FIG. 16, after the conductor wires 31 and 32 are connected to the antenna pattern 15, the connection portions are covered with a resin material 86. The resin material 86 functions as a reinforcing member. The resin material 86 may be the same material as the insulating adhesive layer 20.

Figure 17:
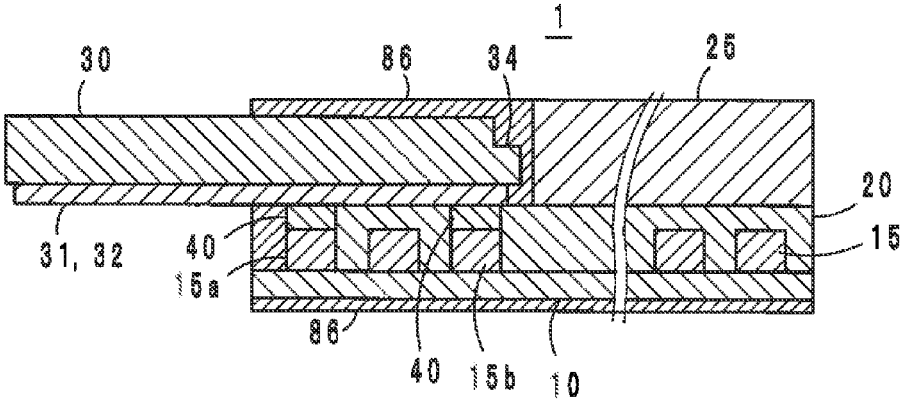
FIG. 17 is a sectional view of the antenna device, illustrating a third example of reinforcement of connection portions.

A third example of reinforcement is a modification of the second example of reinforcement. As illustrated in FIG. 17, in the third example, the end portion of the insulating base 30 is stepped (see portion 34 in FIG. 17), and the stepped end portion 34 is covered with a resin material 86. Further, the lower surface of the first insulating base 10 is covered with the resin material 86. In the third example, it is preferred that the same material as the insulating adhesive layer 20 is used as the resin material 86. In this case, preferably, the resin material 86 is applied onto the connection portions by screen printing, potting or the like, and the resin material 86 is hardened by a UV radiation process, a heating process or the like. In a case where the same material as the insulating adhesive layer 20 is used as the resin material 86, the insulating adhesive layer 20 and the resin material 86 have the same thermal expansion coefficient, and consequently, the risk that the resin material 86 peels off due to a change in temperature is significantly reduced.

Figure 18:
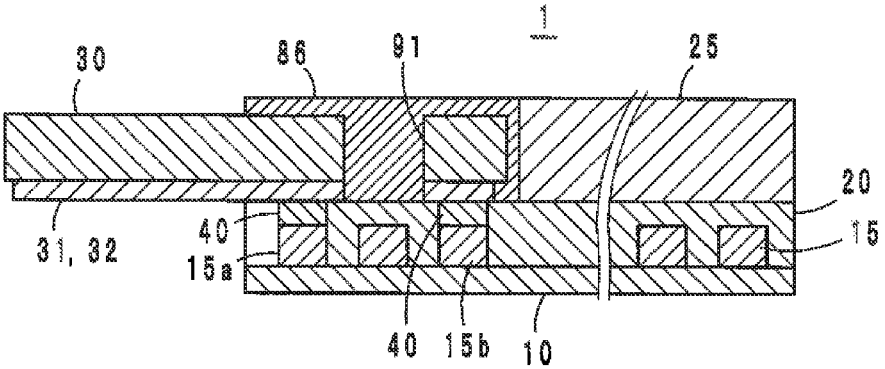
FIG. 18 is a sectional view of the antenna device, illustrating a fourth example of reinforcement of connection portions.

In a fourth example of reinforcement, as illustrated in FIG. 18, a through hole 91 is made to pierce through the second insulating base 30 from the front surface to the back surface, and the through hole 91 is filled with a resin material 86 for reinforcement. The through hole 91 is formed at a portion where the conductor wires 31 and 32 are not located.

Figure 19:
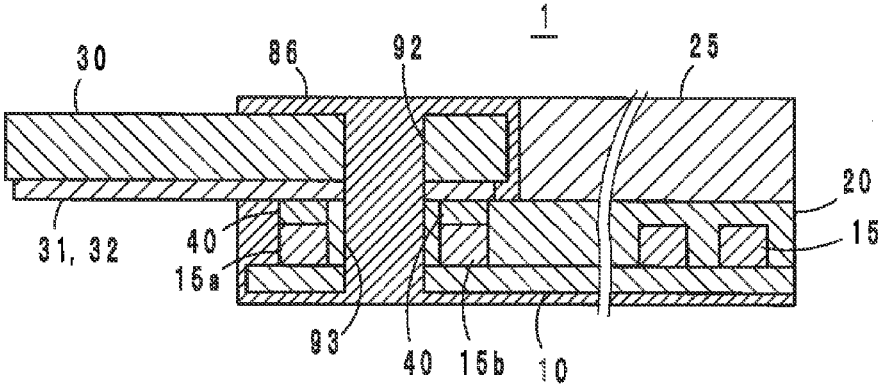
FIG. 19 is a sectional view of the antenna device, illustrating a fifth example of reinforcement of connection portions.

In a fifth example of reinforcement, as illustrated in FIG. 19, a through hole 92 is made to pierce through the second insulating base 30 from the front surface to the back surface, and a through hole 93 is made to pierce through the first insulating base 10 and the insulating adhesive layer 20 from the front surface to the back surface. The through holes 92 and 93 are filled with a resin material 86 for reinforcement. The through holes 92 and 93 are formed at portions where the conductor wires 31, 32 and the antenna pattern 15 are not located. In the case of FIG. 19, the through holes 92 and 93 are located on the same axis. However, such coaxial arrangement of the through holes 92 and 93 is not always necessary.

Fifth Preferred Embodiment

Figure 20:
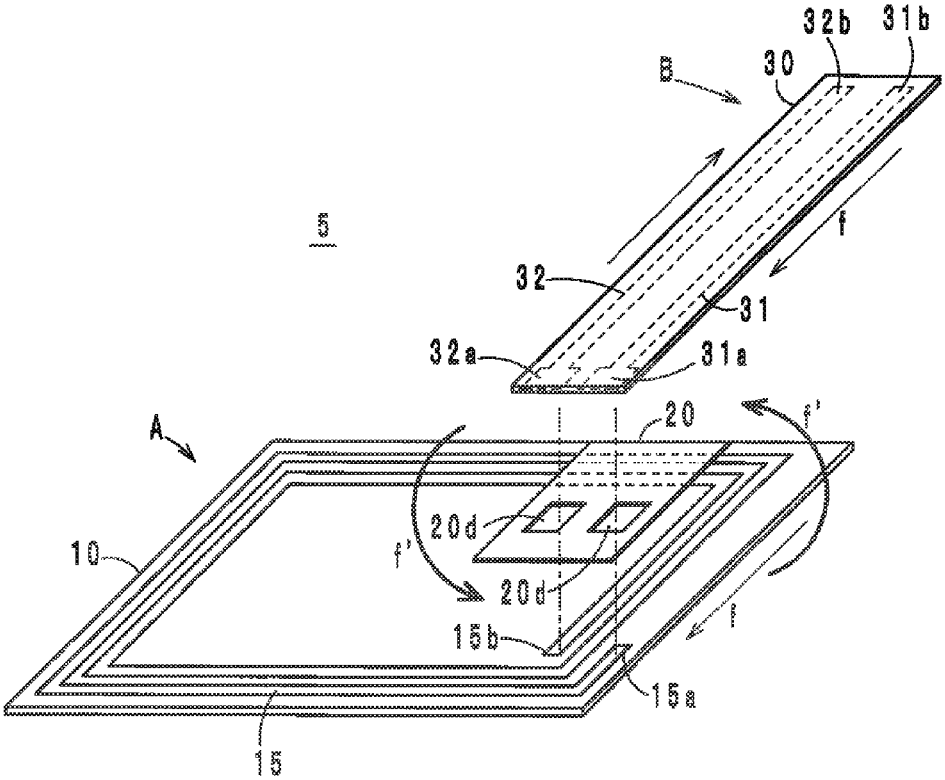
FIG. 20 is a perspective view of an antenna device according to a fifth preferred embodiment of the present invention.
Figure 21:
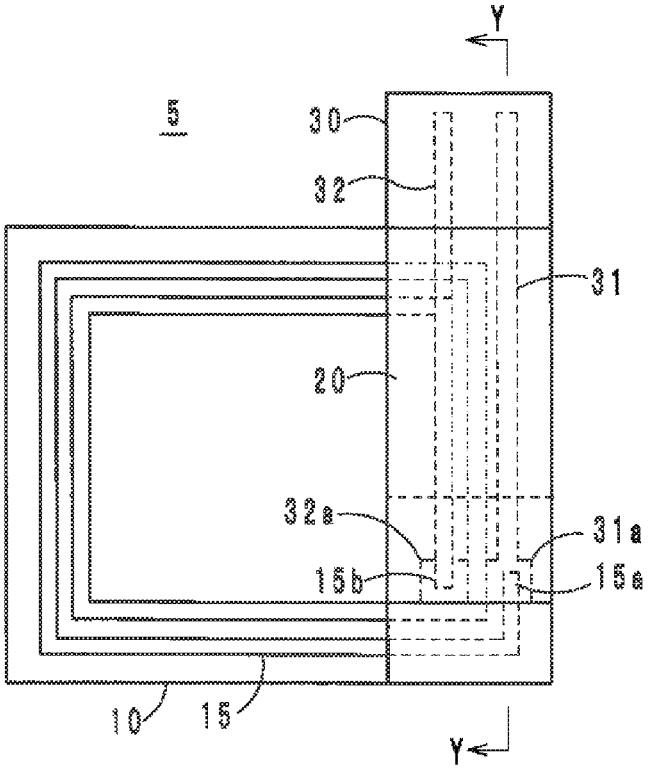
FIG. 21 is a plan view of the antenna device according to the fifth preferred embodiment of the present invention.

As illustrated in FIG. 20, an antenna device 5 according to a fifth preferred embodiment of the present invention includes a first insulating base portion A and a second insulating base portion B. The first insulating base portion includes a spiral antenna pattern 15 including a first end 15*a* and a second end 15*b*, and the second insulating base portion B includes at least two conductor wires 31 and 32 provided thereon. The conductor wires 31 and 32 are electrically connected to the first end 15*a* and the second end 15*b*, respectively, of the antenna pattern 15. In the outermost portion of the antenna pattern 15 and in one of the conductor wires located closest to the outermost portion of the antenna pattern 15 (the conductor wire 31 in the case illustrated in FIGS. 20 and 21; see the plan view of FIG. 21), currents flow in the same direction as indicated by arrows f.

Figure 22:
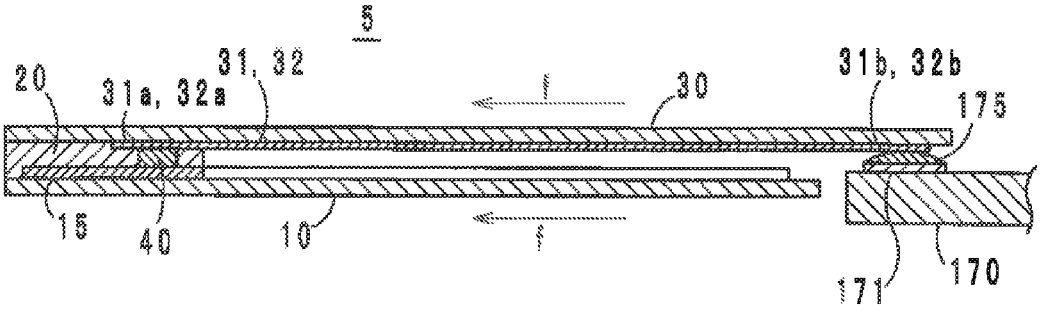
FIG. 22 is a sectional view of the antenna device illustrated in FIG. 21

Between the first insulating base 10 and the second insulating base 30, an insulating adhesive layer 20 is provided. More specifically, the insulating adhesive layer 20 is provided only in a portion where the conductor wires 31 and 32 contact with the antenna pattern 15. In order to ensure the electrical connections between the electrode portion 31*a* of the conductor wire 31 and the first end 15*a* of the antenna pattern 15 and between the electrode portion 32*a* of the conductor wire 32 and the second end 15*b* of the antenna pattern 15, the insulating adhesive layer 20 includes openings 20*d* (see solder 40 in FIG. 22). FIG. 22 is a sectional view of the antenna device 5 along the line Y-Y indicated in FIG. 21. The sectional views that will be made reference to below are sectional views along lines in the same portion.

In the antenna device 5, the outermost portion of the spiral antenna pattern 15 is configured to determine the antenna characteristics to a great degree. Since currents f flow in the same direction in the outermost portion of the spiral antenna pattern 15 and in the conductor wire 31 located closest to the outermost portion of the spiral antenna pattern 15, magnetic fields generated there are in the same direction as indicated by arrows f' in FIG. 20. Accordingly, there is no risk that the magnetic field generated from the outermost portion of the antenna pattern 15 is offset by the magnetic field generated from the conductor wire 31, and degradation of the antenna characteristics is prevented.

The contact portions (the electrode portions 31*a* and 31*b*) of the conductor wires 31 and 32 to come into contact with the antenna pattern 15 have a greater line width than the antenna pattern 15. This arrangement allows prevention of disconnection at the contact portions between each of the conductor wires 31 and 32 and the antenna pattern 15, and results in an improvement in the connection reliability.

According to the fifth preferred embodiment, the second insulating base portion B (the second insulating base 30) does not always need to be bent when the antenna device 5 is used. As illustrated in FIG. 22, the terminals 31*b* and 32*b* of the conductor wires 31 and 32 are capable of being connected to lands 171 on a printed wiring board 170 via solder 175 while the second insulating base 30 is stretched out. Therefore, the second insulating base 30 does not need to have excellent flexibility.

First Modification to Fifth Preferred Embodiment

Figure 23:
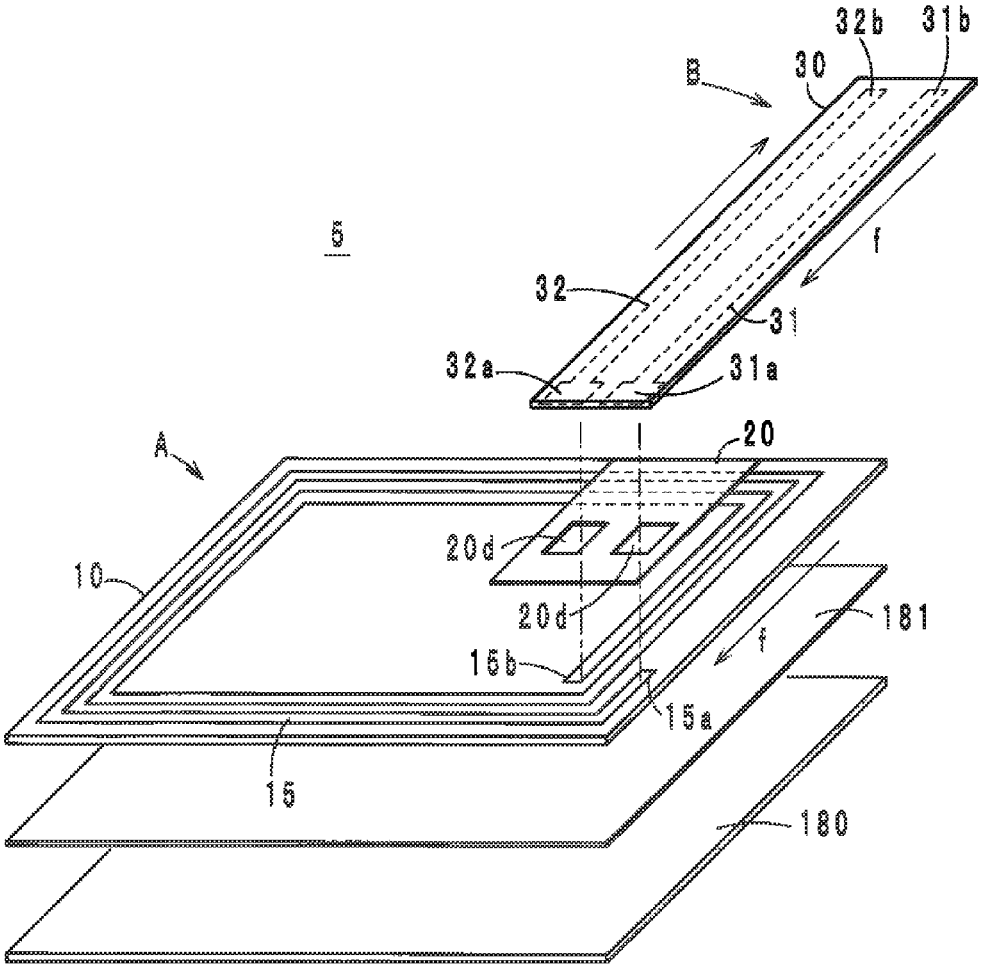
FIG. 23 is a perspective view of an antenna device according to a first modification to the fifth preferred embodiment of the present invention.

The antenna device 5 according to the fifth preferred embodiment can be modified as illustrated in FIG. 23. Specifically, a ferrite sheet 180 that is equal or substantially equal in area to the insulating base 10 may be bonded to the back surface of the first insulating base 10 via an insulating adhesive layer 181. The provision of the ferrite sheet 180 in the vicinity of the antenna pattern 15 allows enhancement of the density of magnetic flux generated from the antenna pattern 15, and consequently results in an improvement of the antenna characteristics.

Second Modification to Fifth Preferred Embodiment

Figure 24:
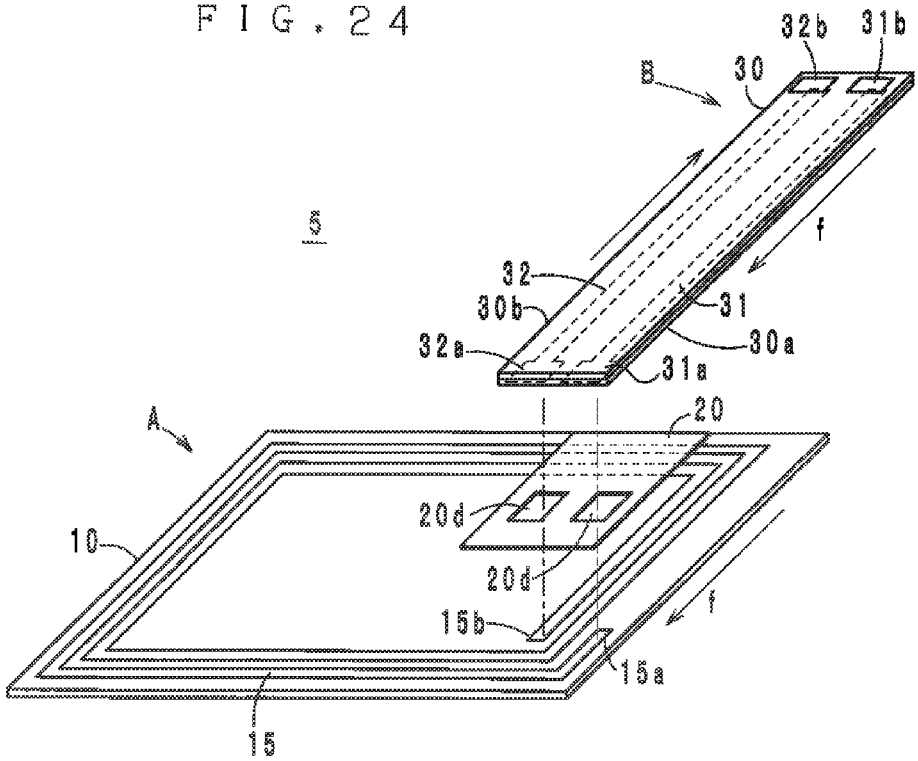
FIG. 24 is a perspective view of an antenna device according to a second modification to the fifth preferred embodiment of the present invention.
Figure 25:
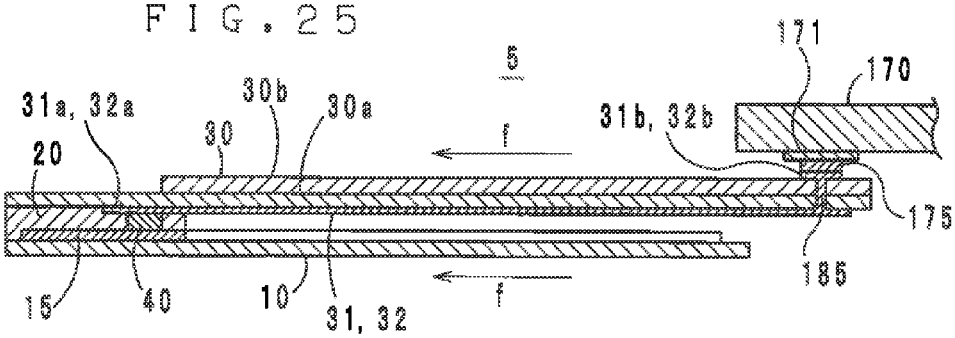
FIG. 25 is a sectional view of the antenna device illustrated in FIG. 24.

The antenna device 5 according to the fifth preferred embodiment can be also modified as illustrated in FIGS. 24 and 25. Specifically, the second insulating base 30 may include a laminate of two base plates 30*a* and 30*b*. Ends of the conductor wires 31 and 32 on the lower surface of the base plate 30*a* may be connected to the terminals 31*b* and 32*b*, respectively, located on the upper surface of the base plate 30*b* via interlayer connection conductors 185. The provision of the terminals 31*b* and 32*b* on the upper surface of the base 30 allows connection of the conductor wires 31 and 32 to lands 171 on a printed wiring board 170 located on the opposite side of the second insulating base 30 from the first insulating base 10 without bending the second insulating base 30. Accordingly, there is no risk that breakage of the conductor wires 31 and 32 is caused by bending of the second insulating base 30. Also, it is possible to connect the terminals 31*b* and 32*b* to the lands 171 easily by applying heat to the end portions of the conductor wires 31 and 32 by use of a heater, for example, a heater bar. In this regard, the heat is transferred to the terminals 31*b* and 32*b*, the solder 175 and the lands 171 via the interlayer connection conductors 185.

Figure 26:
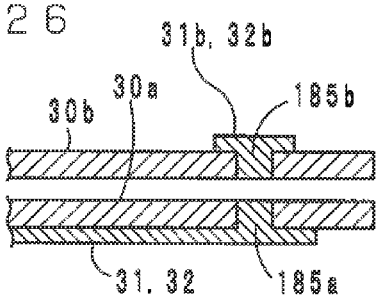
FIG. 26 is a sectional view of an interlayer connection conductor.

The interlayer connection conductors 185 are preferably formed as follows. As illustrated in FIG. 26, holes are pierced in the base plates 30*a* and 30*b*, which are made of thermoplastic resin, and the holes are filled with conductive paste 185*a* and 185*b* so as to connect the conductor wire 31 to the terminal 31*b* and connect the conductor wire 32 to the terminal 32*b*. Thereafter, simultaneously with heating and pressure-bonding the base plates 30*a* and 30*b* together, the conductive paste 185*a* and 185*b* is solidified. Thus, the conductive paste 185*a* and 185*b* is joined and electrically conducted together, and the interlayer connection conductors 185 are formed. The interlayer connection conductors 185 may be through holes 81 that can be formed by the process illustrated in FIGS. 15A-15D. However, in a case where the interlayer connection conductors 185 are via-holes formed by the process illustrated by FIG. 26, it is not necessary to carry out plating, which is needed in the process of forming a through hole, and the manufacturing process is simplified.

Third Modification to Fifth Preferred Embodiment

Figure 27:
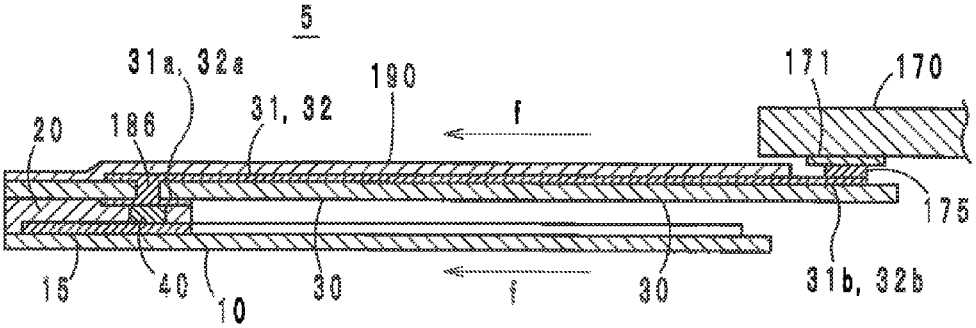
FIG. 27 is a sectional view of an antenna device according to a third modification to the fifth preferred embodiment of the present invention.

The antenna device 5 according to the fifth preferred embodiment can be also modified as illustrated in FIG. 27. The conductor wires 31 and 32 may be provided on the upper surface of the second insulating base 30, and ends of the conductor wires 31 and 32 may be connected to the electrode portions 31*a* and 32*a*, respectively, via interlayer connection conductors 186. On the upper surface of the insulating base 30, a resist layer 190 is provided.

Fourth Modification to Fifth Preferred Embodiment

Figure 28:
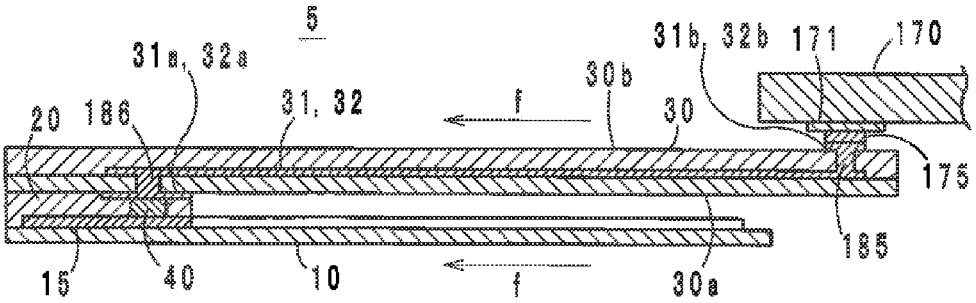
FIG. 28 is a sectional view of an antenna device according to a fourth modification to the fifth preferred embodiment of the present invention.

The antenna device 5 according to the fifth preferred embodiment can be also modified as illustrated in FIG. 28. The second insulating base 30 may be a laminate of base plates 30*a* and 30*b*. The conductor wires 31 and 32 are provided on the upper surface of the base plate 30*a*. Ends of the conductor wires 31 and are connected to the electrode portions 31*a* and 32*a*, respectively, provided on the lower surface of the base plate 30*a* via interlayer connection conductors 186, and the other ends of the conductor wires 31 and 32 are connected to the terminals 31*b* and 32*b*, respectively, provided on the upper surface of the base plate 30*b* via interlayer connection conductors 185. The electrode portions 31*a* and 31*b* are connected to the first end 15*a* and the second end 15*b*, respectively, of the antenna pattern 15 via solder 40, and the terminals 31*b* and 32*b* are connected to lands 171 on a printed wiring board 170 via solder 175.

Sixth Preferred Embodiment

Figure 29:
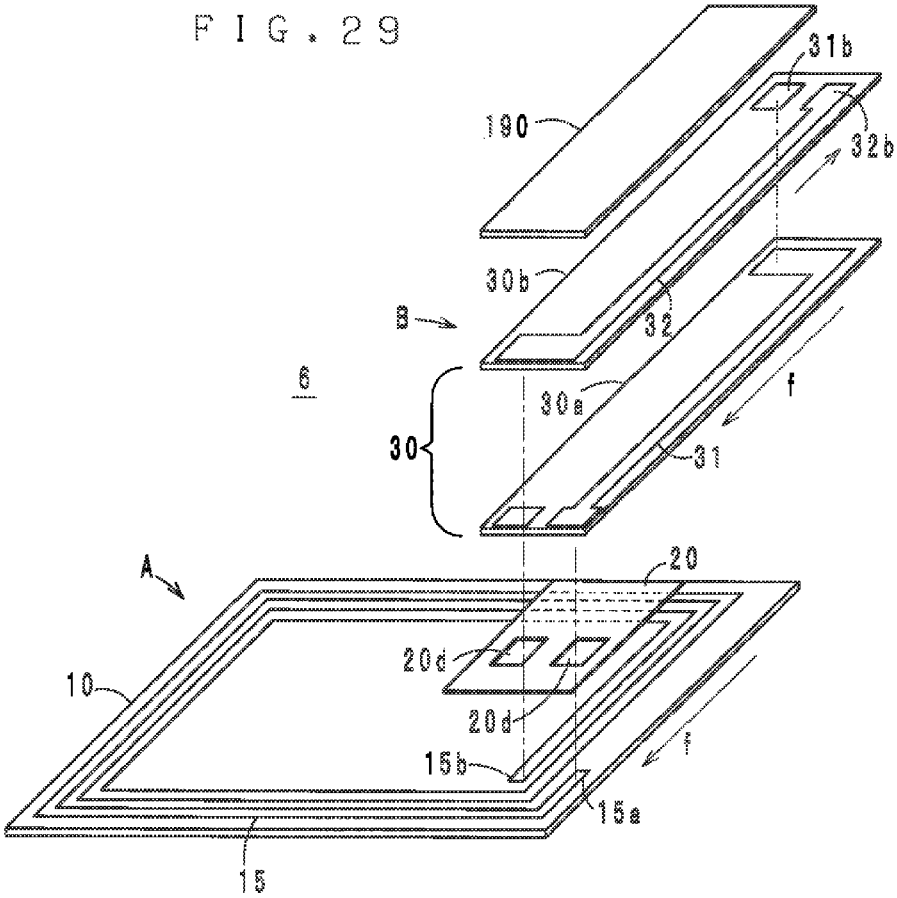
FIG. 29 is a perspective view of an antenna device according to a sixth preferred embodiment of the present invention.
Figure 30:
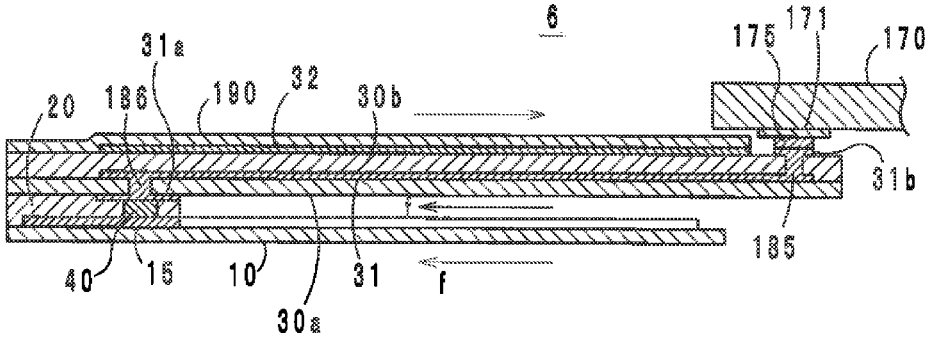
FIG. 30 is a sectional view of the antenna device illustrated in FIG. 29.

In an antenna device 6 according to a sixth preferred embodiment, as illustrated in FIG. 29, the conductor wires 31 and 32 are arranged in the second insulating base portion B so as to overlap with each other in the thickness direction (in a planar view). Specifically, the conductor wire 31 is provided on the base plate 30*a*, and the conductor wire 32 is provided on the base plate 30*b*. Further, a resist layer 190 is provided on the base plate 30*b*. As illustrated in FIG. 30, an end of the conductor wire 31 is connected to the electrode portion 31*a* provided on the lower surface of the base plate 30*a* via an interlayer connection conductor 186. An end of the conductor wire 32 is connected to the electrode portion 32*a* provided on the lower surface of the base plate 30*a* via an interlayer connection conductor although it is not illustrated in FIG. 30. The other end of the conductor wire 31 is connected to the terminal 31*b* provided on the upper surface of the base plate 30*b* via an interlayer connection conductor 185 provided in the base plate 30*b*.

The other portions of the sixth preferred embodiment preferably have the same structure as the fifth preferred embodiment and the modifications thereto. In the structure, as described in connection with the fifth preferred embodiment, in the outermost portion of the antenna pattern 15 and in the conductor wire 31 located closest to the outermost portion of the antenna pattern 15, currents flow in the same direction as indicated by arrows f. Accordingly, there is no risk that a magnetic field generated from the outermost portion of the antenna pattern 15 is offset by a magnetic field generated from the conductor wire 31, and degradation of the antenna characteristics is prevented.

Antenna Device According to Seventh Preferred Embodiment

Figure 31:
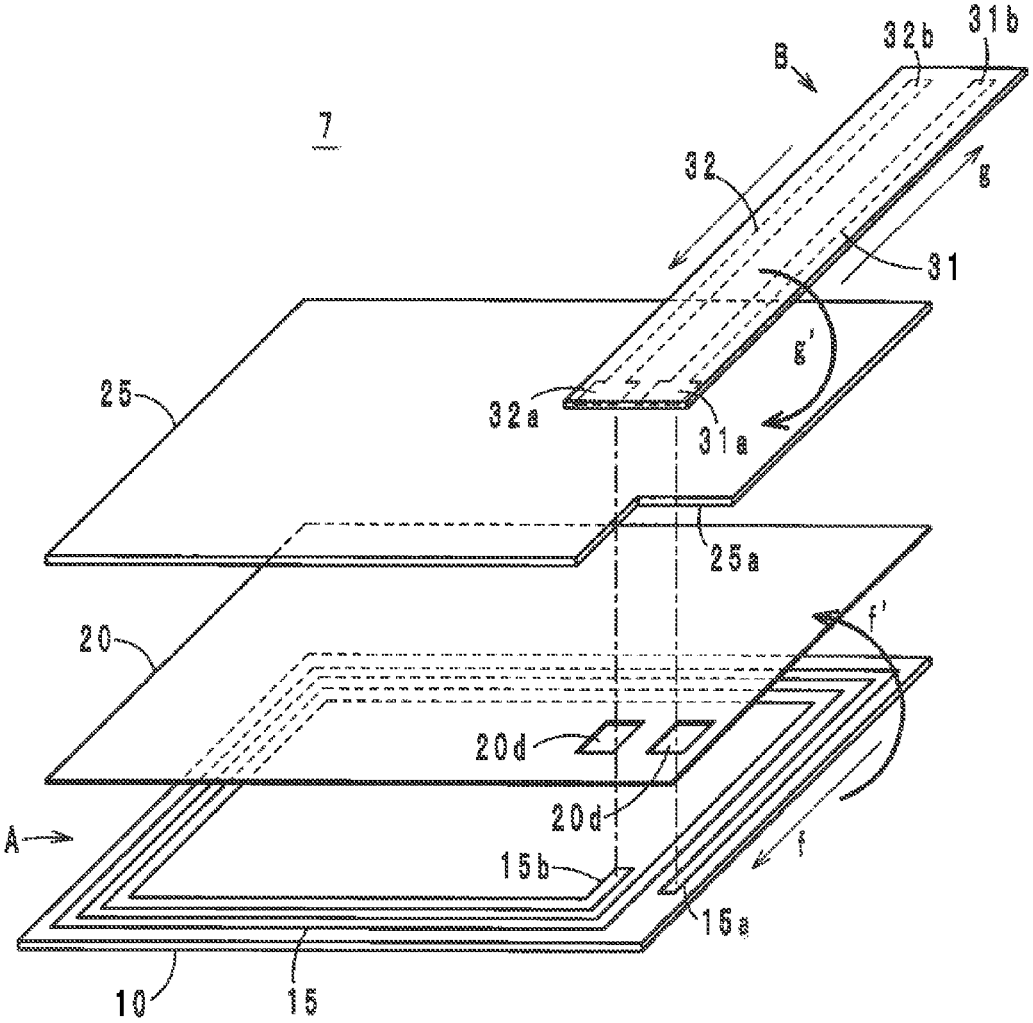
FIG. 31 is a perspective view of an antenna device according to a seventh preferred embodiment of the present invention.
Figure 32:
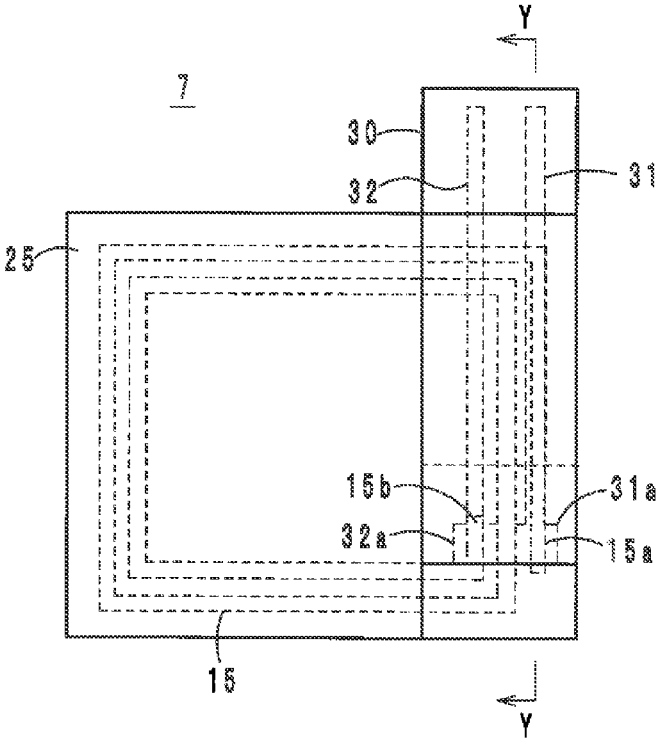
FIG. 32 is a plan view of the antenna device according to the seventh preferred embodiment of the present invention.

As illustrated in FIG. 31, an antenna device 7 according to a seventh preferred embodiment includes a first insulating base portion A, a second insulating base portion B, and a magnetic member (ferrite sheet 25) provided between the first insulating base portion A and the second insulating base portion B. The first insulating base portion includes a spiral antenna pattern 15 including a first end 15*a* and a second end 15*b*, and the second insulating base portion B includes at least two conductor wires 31 and 32 provided thereon. In the antenna device 7 according to the seventh preferred embodiment, the antenna pattern 15 spirals on the first insulating base 10 in a direction opposite to those of the antenna devices according to the preferred embodiments above. The two conductor wires 31 and 32 are electrically connected to the first end 15*a* and the second end 15*b*, respectively, of the antenna pattern 15. In the outermost portion of the antenna pattern 15 and in one of the conductor wires that is located closest to the outermost portion of the antenna pattern 15 (the conductor wire 31 in the case illustrated in FIGS. 31 and 32; see the plan view of FIG. 32), currents flow in opposite directions as indicated by arrows f and g.

Figure 33:
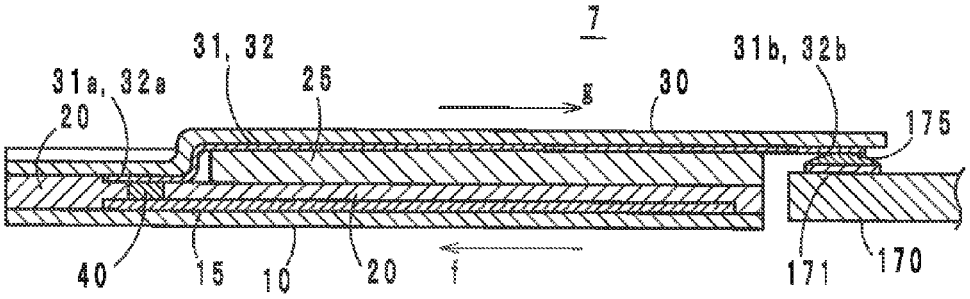
FIG. 33 is a sectional view of the antenna device illustrated in FIG. 32.

Further, an insulating adhesive layer 20 is provided between the first insulating base 10 and the ferrite sheet 25. More specifically, the ferrite sheet 25 and the insulating adhesive layer 20 are equal or substantially equal in area to the first insulating base 10. In order to ensure electrical connections between the electrode portion 31*a* of the conductor wire 31 and the first end 15*a* of the antenna pattern 15 and between the electrode portion 32*a* of the conductor wire 32 and the first end 15*b* of the antenna pattern 15 (see solder 40 in FIG. 33), the insulating adhesive layer 20 includes openings 20*d*. For the same purpose, the ferrite sheet 25 includes a cut 25*a*.

In the antenna device 7, the magnetic member (ferrite sheet 25) is provided in the vicinity of the antenna pattern 15, and therefore, the magnetic field around the antenna pattern 15 is strengthened. Also, in the outermost portion of the antenna pattern 15 and in one of the conductor wires that is located closest to the outermost portion of the antenna pattern 15 (the conductor wire 31 in the case illustrated in FIGS. 31 and 32; see the plan view of FIG. 32), currents f and g flow in opposite directions, and therefore, a magnetic field f' generated from the outermost portion of the antenna pattern 15 and a magnetic field g' generated from the conductor wire 31 located closest to the outermost portion of the antenna pattern 15 are in the same direction inside the magnetic member (ferrite sheet 25) and are not offset by each other. Accordingly, degradation of the antenna characteristics is prevented. Further, the antenna device 7 according to the seventh preferred embodiment has the same effects as the antenna device 5 according to the fifth preferred embodiment.

First Modification to Seventh Preferred Embodiment

Figure 34:
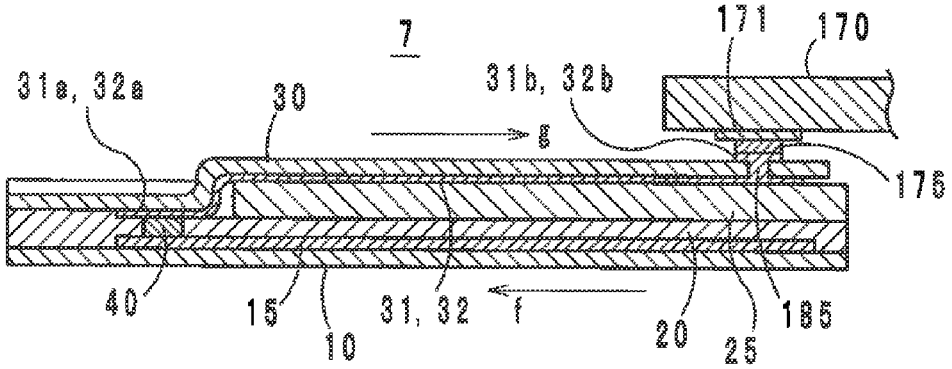
FIG. 34 is a sectional view of an antenna device according to a first modification to the seventh preferred embodiment of the present invention.

The antenna device 7 according to the seventh preferred embodiment can be modified as illustrated in FIG. 34. Specifically, ends of the conductor wires 31 and 32 on the lower surface of the second insulating base 30 may be connected to the terminals 31*b* and 32*b*, respectively, on the upper surface of the insulating base 30 via interlayer connection conductors 185. The provision of the terminals 31*b* and 32*b* on the upper surface of the insulating base 30 allows connection of the terminals 31*b* and 32*b* to lands 171 on a printed wiring board 170 located on the opposite side of the second insulating base 30 from the first insulating base 10 via solder 175 without bending the second insulating base 30. Accordingly, there is no risk that breakage of the conductor wires 31 and 32 is caused by bending of the second insulating base 30.

Second Modification to Seventh Preferred Embodiment

Figure 35:
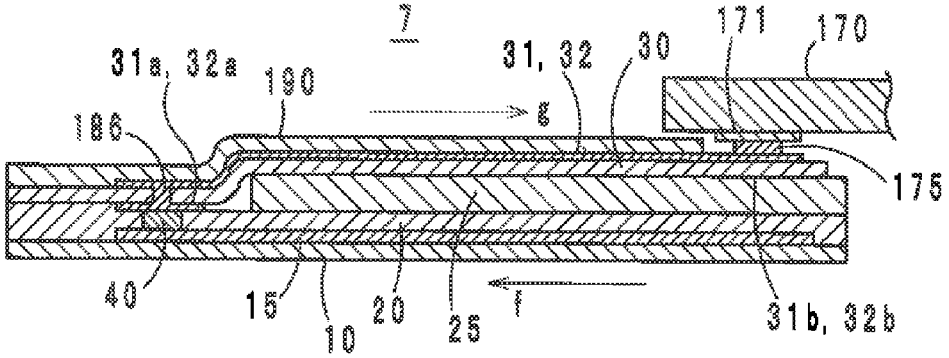
FIG. 35 is a sectional view of an antenna device according to a second modification to the seventh preferred embodiment of the present invention.

The antenna device 7 according to the seventh preferred embodiment can be also modified as illustrated in FIG. 35. In the modification illustrated in FIG. 35, the conductor wires 31 and 32 are provided on the upper surface of the second insulating base 30, and ends of the conductor wires 31 and 32 are connected to the electrode portions 31*a* and 32*a*, respectively, via interlayer connection conductors 186. On the upper surface of the insulating base 30, a resist layer 190 is provided.

Third Modification to Seventh Preferred Embodiment

Figure 36:
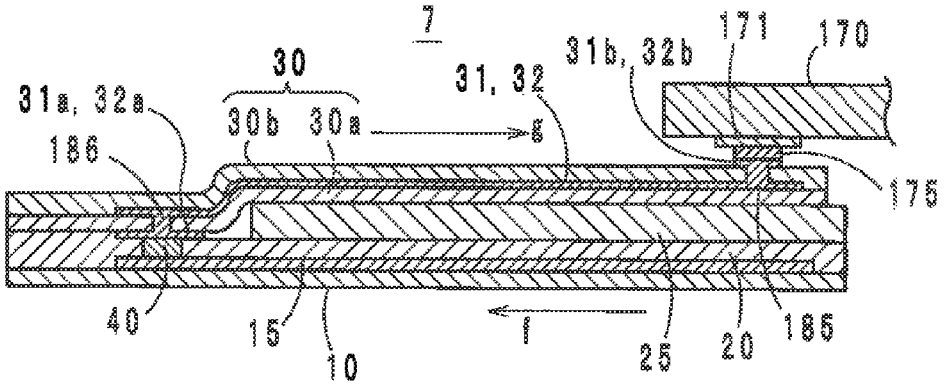
FIG. 36 is a sectional view of an antenna device according to a third modification to the seventh preferred embodiment of the present invention.

The antenna device 7 according to the seventh preferred embodiment can be also modified as illustrated in FIG. 36. In the modification illustrated in FIG. 36, the second insulating base 30 preferably includes a laminate of base plates 30*a* and 30*b*. The conductor wires 31 and 32 are provided on the upper surface of the base 30*a*. Ends of the conductor wires 31 and 32 are connected to the electrode portions 31*a* and 32*a* provided on the lower surface of the base plate 30*a*, respectively, via interlayer connection conductors 186, and the other ends of the conductor wires 31 and 32 are connected to the terminals 31*b* and 32*b* on the upper surface of the base plate 30*b*, respectively, via interlayer connection conductors 185. The electrode portions 31*a* and 31*b* are connected to the ends 15*a* and 15*b*, respectively, of the antenna pattern 15 via solder 40. The terminals 31*b* and 32*b* are connected to lands 171 on a printed wiring board 170 via solder 175.

Fourth Modification to Seventh Preferred Embodiment

Figure 37:
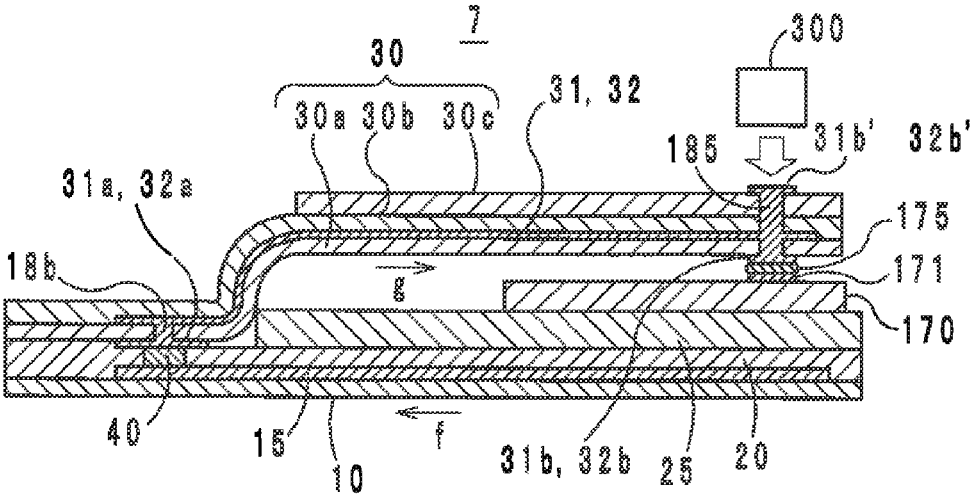
FIG. 37 is a sectional view of an antenna device according to a fourth modification to the seventh preferred embodiment of the present invention.

The antenna device 7 according to the seventh preferred embodiment can be also modified as illustrated in FIG. 37. In the modification illustrated in FIG. 37, the second insulating base 30 preferably is a three-layered base (a laminate of base plates 30*a*, 30*b* and 30*c*). Specifically, on the base plate 30*b* illustrated in FIG. 36, further, another base plate 30*c* is laminated. From an end of the conductor wire 31, terminal portions 31*b* and 31*b*' are led out to the lower surface and the upper surface, respectively, of the second insulating base 30 via an interlayer connection conductor 185. From an end of the conductor wire 32, terminal portions 32*b* and 32*b*' are led out to the lower surface and the upper surface, respectively, of the second insulating base 30 via an interlayer connection conductor 185. The terminals 31*b* and 32*b* are connected to lands 171 on a printed wiring board 170 via solder 175. It is possible to solder the terminals 31*b* and 32*b* to the lands 171 easily by applying heat to the terminal portions 31*b*' and 32*b*' by use of a heater bar. In this regard, the heat is transferred to the terminals 31*b* and 32*b*, the solder 175 and the lands 171 via the interlayer connection conductors 185.

The portion of the second insulating base 30 at and around the connection portions between the antenna pattern 15 and the conductor wires 31 and 32 includes a smaller number of layers and is thinner than the portion where the terminals 31*b* and 32*b* are located. The thinner portion is more flexible and is easy to bend, and therefore, breakage of the conductor wires 31 and 32 prevented. The second insulating base 30 is multilayered (three-layered in this modification), and the conductor wires 31 and 32 are located between the layers. With this arrangement, the conductor wires 31 and 32 is protected effectively.

The second insulating base portion B is thinner than the first insulating base portion A. The first insulating base portion A includes a first insulating base 10, an antenna pattern 15 provided on a main surface of the first insulating base 10, an insulating adhesive layer 20 and a magnetic sheet 25. The second insulating base portion B includes the second insulating base 30 (30*a*, 30*b* and 30*c*), and the conductor wires 31 and 32 provided in the second insulating base 30. The first insulating base 10 is thinner (has a smaller thickness) than the second insulating base 30. Accordingly, the second insulating base portion B is more flexible than the first insulating base portion A, and the second insulating base portion B is easier to bend. Also, since the first insulating base 10 including the antenna pattern 15 is thin, the distance between the antenna pattern 15 and a communicating counterpart, such as an antenna, located on the side of the first insulating base portion A is short, and the antenna device 7 has good communication performance. The flexible first insulating base 10 is easy to follow the shape of an article, for example, a case to which the antenna device 7 is attached (to which the first insulating base 10 of the antenna device 7 is bonded). Moreover, there is no risk that the conductor wires 31 and 32 are displaced and/or broken.

Fifth Modification to Seventh Preferred Embodiment

Figure 38:
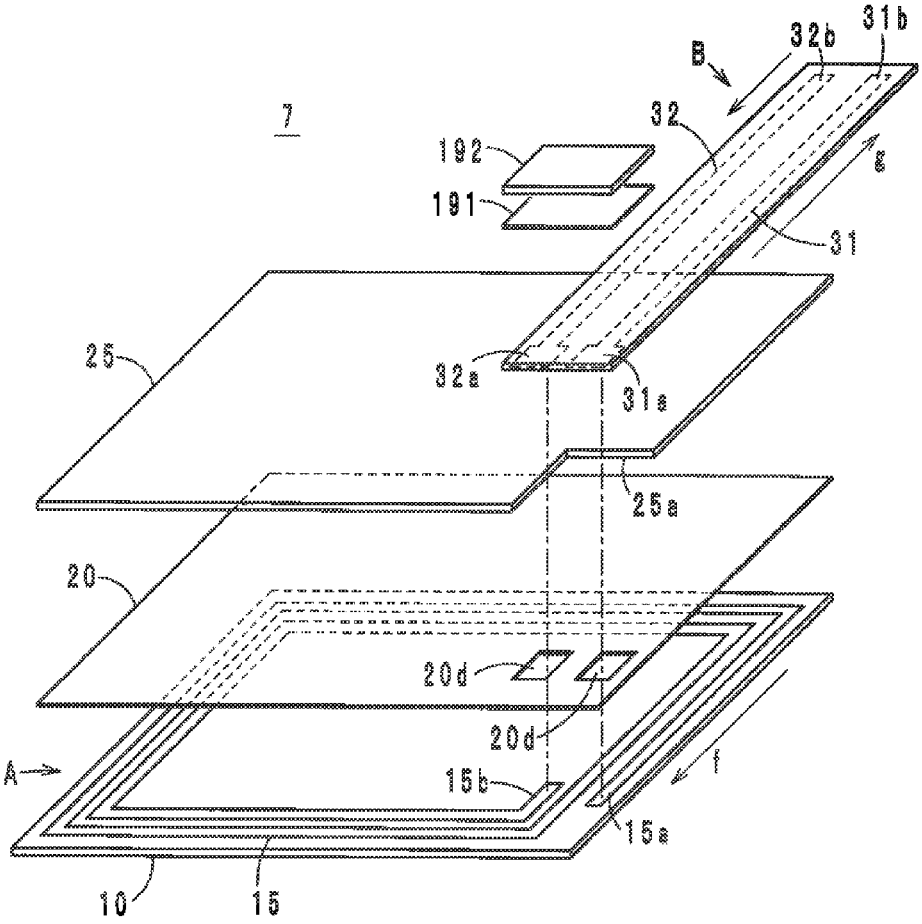
FIG. 38 is a sectional view of an antenna device according to a fifth modification to the seventh preferred embodiment of the present invention.
Figure 39:
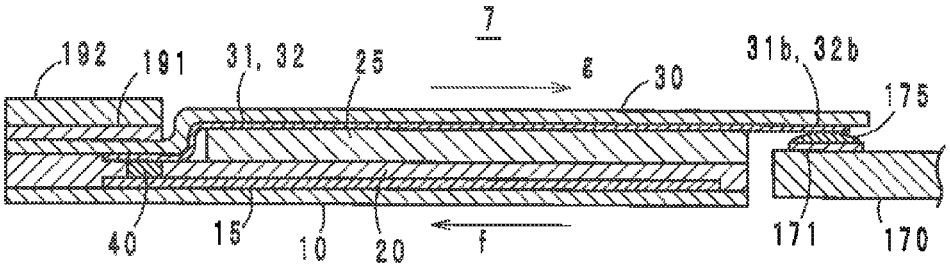
FIG. 39 is a sectional view of the antenna device illustrated in FIG. 38.

The antenna device 7 according to the seventh preferred embodiment can be also modified as illustrated in FIGS. 38 and 39. In the modification illustrated in FIGS. 38 and 39, at and around the contact portions where the antenna pattern 15 is connected to the conductor wires 31 and 32, a ferrite sheet 192 is stuck on the upper surface of the second insulating base 30 via an insulating adhesive layer 191. With this arrangement, the connection between the antenna pattern 15 and each of the conductor wires 31 and 32 is secured. Also, the ferrite sheet 192 is located over the cut 25*a* of the ferrite sheet 25, and the magnetic field of the whole antenna pattern 15 is strengthened.

Antenna Device According to Eighth Preferred Embodiment

Figure 40:
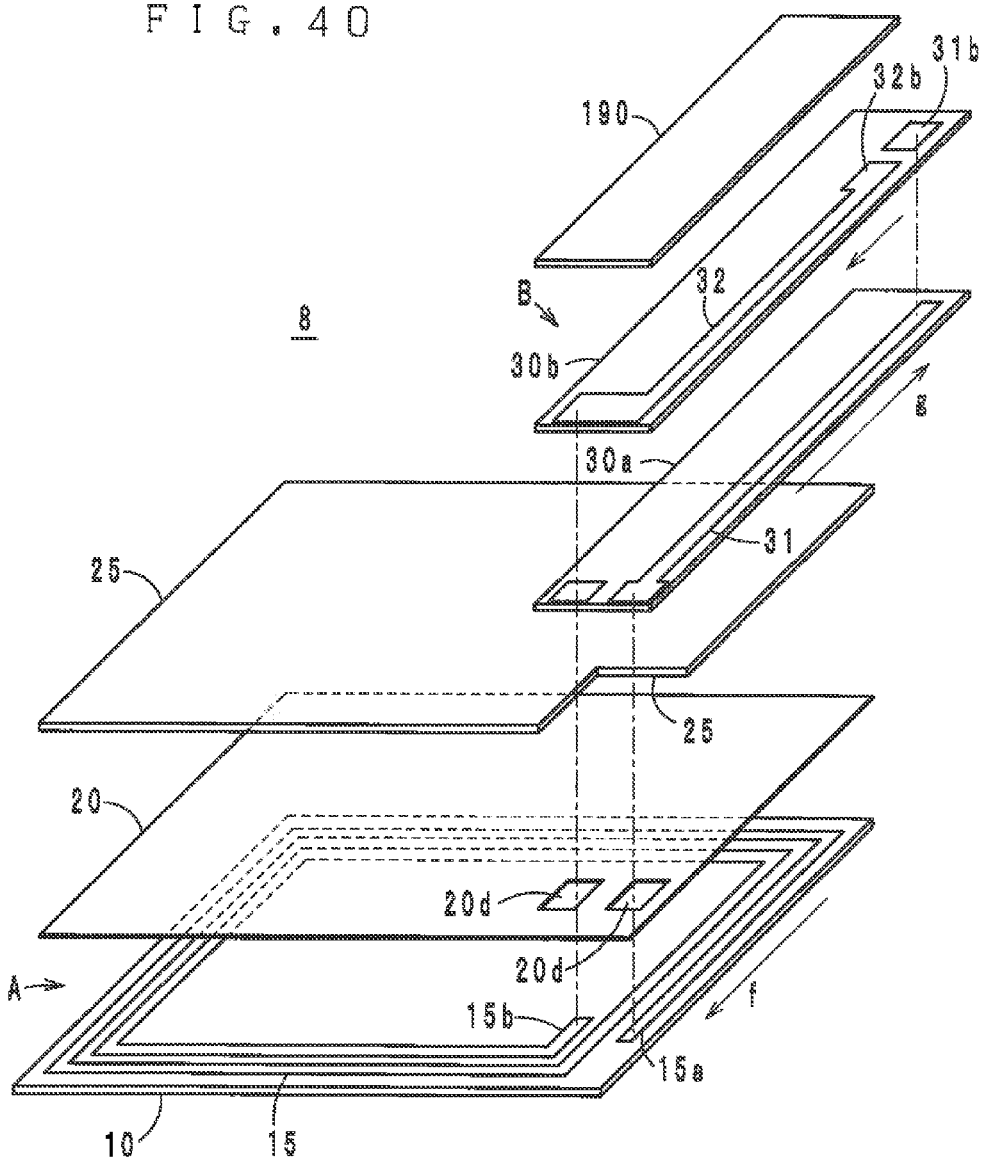
FIG. 40 is a perspective view of an antenna device according to an eighth preferred embodiment of the present invention.
Figure 41:
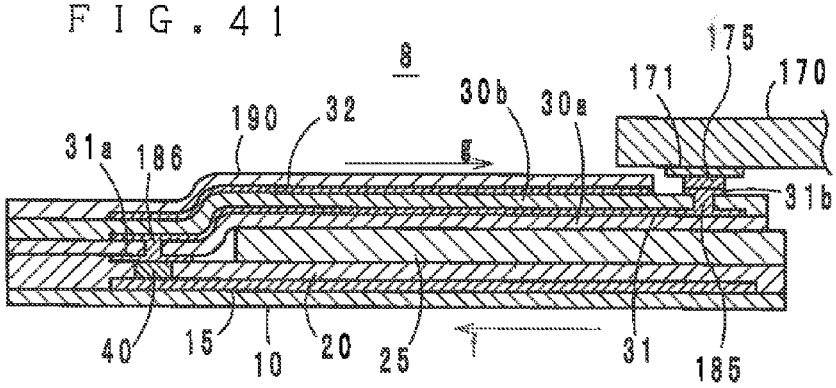
FIG. 41 is a sectional view of the antenna device illustrated in FIG. 40.

In an antenna device 8 according to an eighth preferred embodiment of the present invention, as illustrated in FIG. 40, the conductor wires 31 and 32 are arranged in the second insulating base portion B so as to overlap with each other in the thickness direction (in a planar view). Specifically, the conductor wire 31 is provided on the base plate 30*a*, and the conductor wire 32 is provided on the base plate 30*b*. Further, a resist layer 190 is provided on the base plate 30*b* so as to cover the conductor wire 32. As illustrated in FIG. 41, an end of the conductor wire 31 is connected to the electrode portion 31*a* located on the lower surface of the base plate 30*a* via an interlayer connection conductor 186. An end of the conductor wire 32 is connected to the electrode portion (32*a*) located on the lower surface of the base plate 30*a* via an interlayer connection conductor although it is not illustrated in FIG. 41. The other end of the conductor wire 31 is connected to the terminal 31*b* located on the upper surface of the base plate 30*b* via an interlayer connection conductor 185 formed in the base plate 30*b*.

The other portions of the eighth preferred embodiment preferably have the same structure as the seventh preferred embodiment and the modifications thereto. In the structure, as described in connection with the seventh preferred embodiment, in the outermost portion of the antenna pattern 15 and in the conductor wire 31 located closest to the outermost portion of the antenna pattern 15, currents flow in opposite directions as indicated by arrows f and g. Therefore, a magnetic field generated from the outermost portion of the antenna pattern 15 and a magnetic field generated from the conductor wire 31 located closest to the outermost portion of the antenna pattern 15 are in the same direction inside the magnetic member (ferrite sheet 25) and are not offset by each other. Therefore, degradation of the antenna characteristics is prevented. Further, the antenna device 8 according to the eighth preferred embodiment has the same effects as the antenna devices 5 and 7 according to the fifth and the seventh preferred embodiments.

Figure 42:
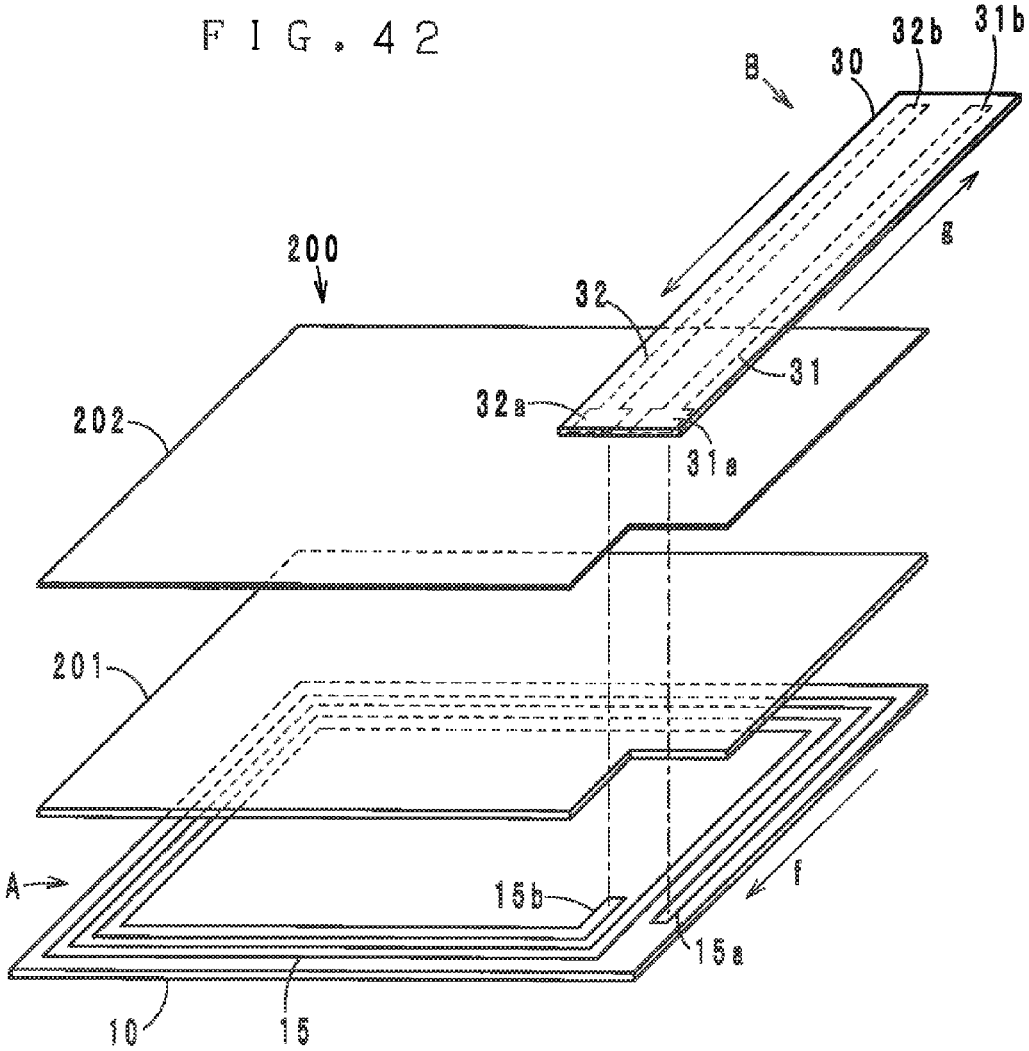
FIG. 42 is an exploded perspective view of an antenna device, illustrating a first example of the position and the configuration of a ferrite sintered body.
Figure 43:
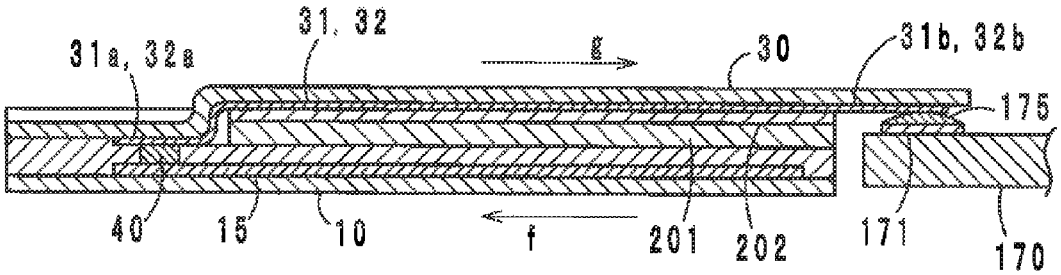
FIG. 43 is a sectional view of the antenna device illustrated in FIG. 42.

In the following, some preferred examples of the position/configuration of the ferrite sintered body is described. FIGS. 42 and 43 illustrate a first example, which includes a first insulating base portion A including a spiral antenna pattern 15 having a first end 15*a* and a second end 15*b*, a second insulating base portion B including at least two conductor wires 31 and 32, and a magnetic member 200 provided between the first insulating portion A and the second insulating portion B.

The conductor wires 31 and 32 are electrically connected to the first end 15*a* and the second end 15*b*, respectively, of the antenna pattern 15. The magnetic member 200 includes a sintered body 201 of a magnetic material and a supporting sheet 202 stuck on the sintered body 201. The sintered body 201 is located on the side of the first insulating base portion A, and the supporting sheet 202 is located on the side of the second insulating portion B. Resin, such as polyethylene terephthalate, polyethylene naphthalate, polyimide, etc. may preferably be used as the material of the supporting sheet 202.

The sintered body 201 is preferably made of a magnetic material such as Ni—Zn-based ferrite or the like, and breaks easily. Therefore, in order to prevent breakage of the sintered body 201, the supporting sheet 202 is bonded to the sintered body 201 by an adhesive (not shown). Since the sintered body 201 is located on the side of the first insulating base portion A (that is, on the side of the antenna pattern 15), the magnetic flux density of the antenna pattern 15 is heightened, and the antenna characteristics are improved. Also, since the supporting sheet 202 is located on the side of the second insulating base portion B, the magnetic permeability therearound is lowered, and the magnetic fields generated from the conductor wires 31 and 32 are prevented from interfering with the antenna pattern 15.

An antenna device includes a first insulating base portion including a spiral antenna pattern including a first end and a second end, a second insulating base portion including at least two conductor wires, and a sintered body of a magnetic material provided between the first insulating portion and the second insulating portion. The two conductor wires are electrically connected to the first end and the second end, respectively, of the antenna pattern. In the sintered body, slits may be provided in a matrix such that, in areas near the antenna pattern, the slits extend parallel or substantially parallel to the directions of magnetic fluxes generated from the antenna pattern.

Figure 44:
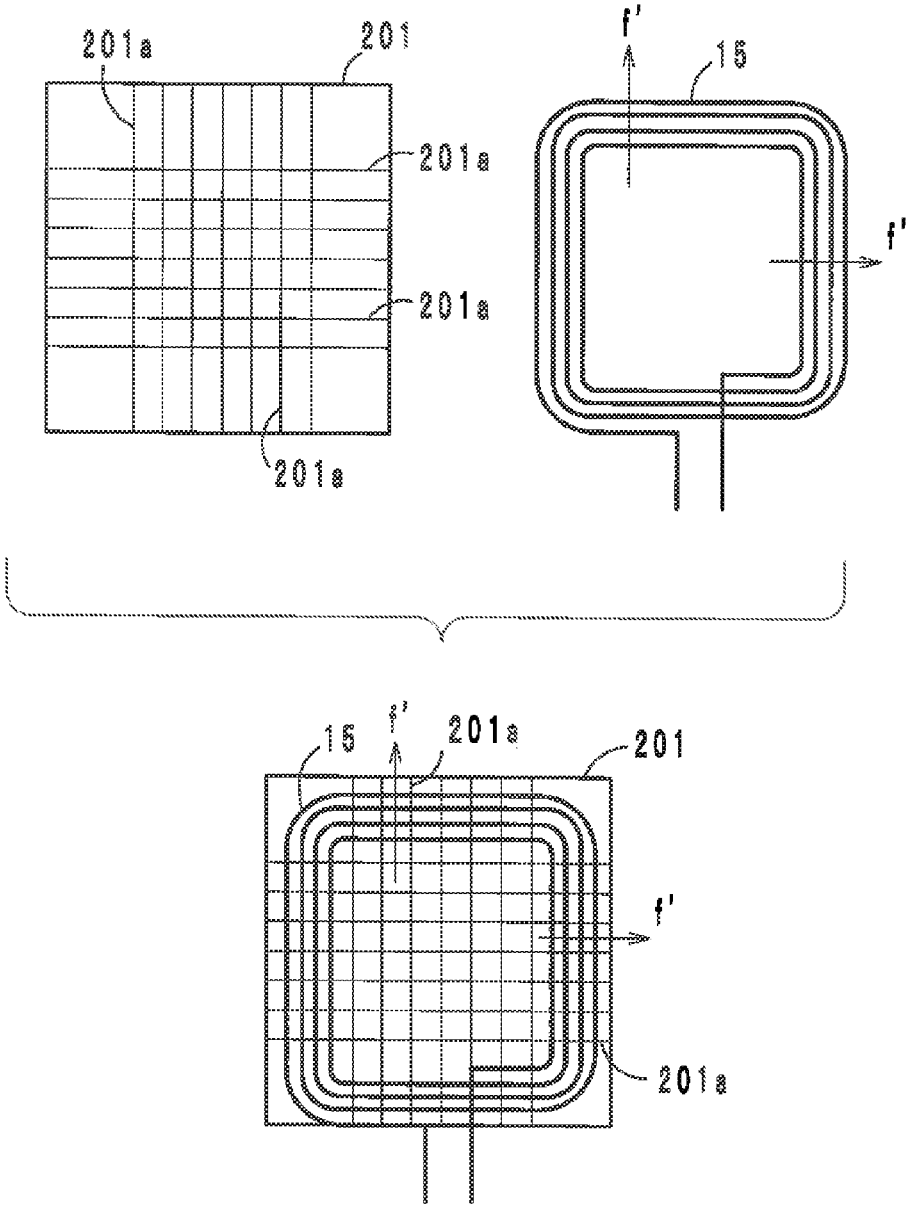
FIG. 44 is a plan view of an antenna device, illustrating a second example of the position and the configuration of a ferrite sintered body.

Since the magnetic sintered body breaks easily, the slits may be formed in a matrix preliminarily. In this regard, if the slits extend parallel or substantially parallel to the straight portions of the antenna pattern in an area near the antenna pattern, the slits block the magnetic fluxes generated from the antenna pattern, and the magnetic permeability is lowered. In order to prevent this problem, as illustrated in FIG. 44, the slits 201*a* are formed in the sintered body 201 in a matrix so as to extend in directions f' parallel or substantially parallel to the directions of magnetic fluxes generated from the antenna pattern 15. With this arrangement, there is no risk that the slits 201*a* block the magnetic fluxes generated from (the straight portions) of the antenna pattern 15, and a reduction in the magnetic permeability is prevented.

The slits 201*a* may be pierced in the sintered body 201 from the front main surface to the back main surface. Alternatively, the slits 201*a* do not need to be pierced in the sintered body 201 and may be provided on either the front main surface or the back main surface of the sintered body 201.

An antenna device includes a first insulating base portion including a spiral antenna pattern including a first end and a second end, a second insulating base portion including at least two conductor wires, and a sintered body of a magnetic material provided between the first insulating portion and the second insulating portion. The two conductor wires are electrically connected to the first end and the second end, respectively, of the antenna pattern. Slits may be provided in a matrix in the sintered body except for areas near the antenna pattern.

Figure 45A:
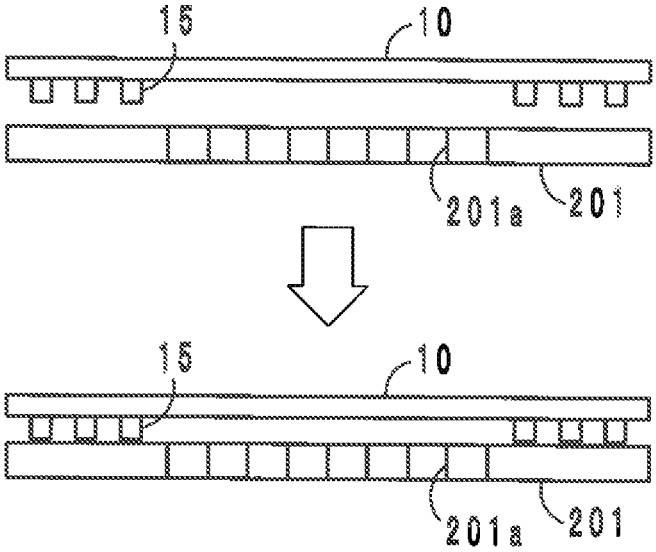
FIG. 45A indicates sectional views of an antenna device, illustrating a third example of the position and the configuration of a ferrite sintered body, and FIG. 45B indicates sectional views of an antenna device, illustrating a comparative example of the position and the configuration of a ferrite sintered body.
Figure 45B:
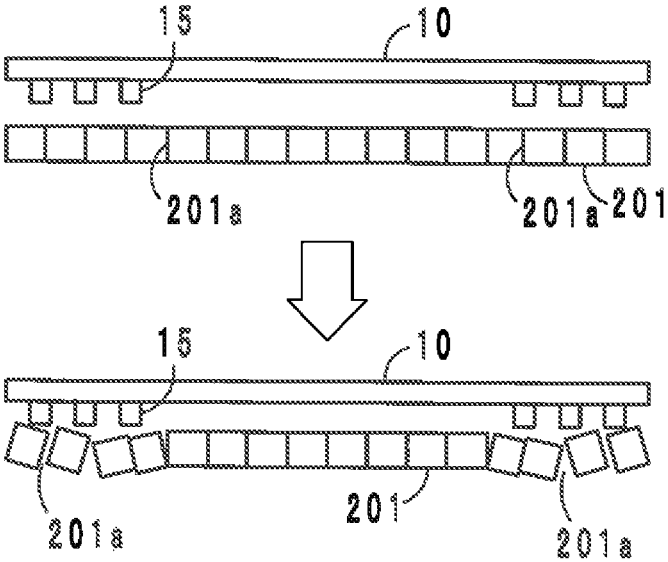

As illustrated in FIG. 45B, when the sintered body 201 is bonded to the insulating base 10 including the antenna pattern 15 thereon, the slits 201*a* may be forced to become wider, thus resulting in a change in the magnetic permeability. In the third example, however, no slits 201*a* are provided in areas near the antenna pattern 15 as illustrated in FIG. 45A. Therefore, there is no risk that the slits 201*a* are widened in areas near the antenna pattern 15, and a reduction in the magnetic permeability is prevented.

Other Preferred Embodiments

Antenna devices and communication terminal apparatuses according to the present invention are not limited to the preferred embodiments above, and various changes and modifications are possible within the scope of the present invention.

For example, the ferrite sheet as the magnetic sheet is not indispensable. Instead of the insulating adhesive layer, a non-adhesive insulating layer may be provided. In this case, the non-adhesive insulating layer does not always need to cover the entire upper surface of the first insulating base. The non-adhesive insulating layer only needs to have at least a portion corresponding to the bridge 20*b* for insulation (see FIG. 1), that is, a portion covering the area between the first end and the second end of the antenna pattern in a planar view.

In a case where the ferrite sheet and the insulating adhesive layer are not provided, it is preferred that the first insulating base is thicker than the second insulating base. If the first insulating base is thinner than the second insulating base, the first insulating base deforms relatively easily, and the characteristics of the antenna pattern and/or other elements are likely to change. For example, when the thickness of the second insulating base is within a range from about 50 μm to about 100 μm, the thickness of the first insulating base is set within a range from about 60 μm to about 200 μm.

The detailed structures and the shapes of the antenna pattern and the conductor wires can be designed arbitrarily. Preferred embodiments of the present invention are applicable not only to radio communication apparatuses for an NFC system of a HF band but also to communication apparatuses using other frequency bands, such as UHF bands, for example, and other communication systems.

The material used for connections between the first end 15*a* of the antenna pattern 15 and the electrode portion 31*a* of the conductor wire 31 and between the second end 15*b* of the antenna pattern 15 and the electrode portion 32*a* of the conductor wire 32 is not limited to solder, and a conductive adhesive or any other conductive material can be used.

As thus far described, preferred embodiments of the present invention are useful in an antenna device and a communication terminal apparatus, and preferred embodiments of the present invention achieves the advantages of manufacturing an antenna device without using via-hole conductors and of requiring merely simple wiring for connection to an external device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

a first insulating base portion including an insulating layer and a spiral antenna pattern including a first end and a second end; and a second insulating base portion including at least two conductor wires; wherein the insulating layer and the second insulating base portion are separate and independent layers;

the insulating layer is configured to insulate the at least two conductor wires from the spiral antenna pattern and is provided between the first end and the second end of the spiral antenna pattern in a plan view;

the at least two conductor wires include electrode portions electrically and mechanically connected to the first end and the second end, respectively, of the spiral antenna pattern by a conductive material;

the insulating layer includes a cut or an opening configured such that before the conductor wires are connected to the spiral antenna pattern, at least one of the first end and the second end of the spiral antenna pattern is exposed toward the conductor wires through the cut or the opening;

the at least two conductor wires are connected to the spiral antenna pattern by the conductive material in the cut or the opening of the insulating layer; and the second insulating base portion is more flexible than the first insulating base portion.

2. The antenna device according to claim 1, wherein the second insulating base portion protrudes outward from the first insulating base portion in the plan view.

3. The antenna device according to claim 1, wherein the insulating layer is an insulating adhesive layer.

4. The antenna device according to claim 3, wherein the first insulating base portion further includes a first insulating base and a magnetic sheet provided on a side of a main surface of the first insulating base; and the spiral antenna pattern is provided on the main surface of the first insulating base.

5. The antenna device according to claim 4, wherein the insulating adhesive layer has a smaller thickness than the magnetic sheet.

6. The antenna device according to claim 4, wherein the magnetic sheet includes a cut in a portion facing the first end and the second end of the spiral antenna pattern; and the first end and the second end of the spiral antenna pattern are connected to the respective electrode portions of the at least two conductor wires by the conductive material in the cut of the magnetic sheet.

7. The antenna device according to claim 4, wherein the insulating adhesive layer bonds the magnetic sheet to the first insulating base.

8. The antenna device according to claim 1, wherein the first insulating base has a smaller thickness than the spiral antenna pattern.

9. The antenna device according to claim 1, wherein a cross section of the spiral antenna pattern is trapezoidal.

10. The antenna device according to claim 1, wherein the second insulating base portion includes through holes; and solder defining the conductive material for connection between the spiral antenna pattern and the conductor wires is filled in the through holes.

11. The antenna device according to claim 1, wherein at least a portion of the second insulating base portion including connection portions between the conductor wires and the spiral antenna pattern is coated with a resin material.

12. The antenna device according to claim 11, wherein a through hole pierces through one or both of the first insulating base portion and the second insulating base portion from a front surface to a back surface; and the resin material is filled in the through hole.

13. A communication terminal apparatus comprising:

an antenna device; and a printed wiring board; wherein the antenna device includes:

a first insulating base portion including an insulating layer and a spiral antenna pattern including a first end and a second end;

a second insulating base portion including at least two conductor wires; wherein the insulating layer and the second insulating base portion are separate and independent layers;

the insulating layer is configured to insulate the at least two conductor wires from the spiral antenna pattern and is provided between the first end and the second end of the spiral antenna pattern in a plan view;

the at least two conductor wires include electrode portions electrically and mechanically connected to the first end and the second end, respectively, of the spiral antenna pattern by a conductive material;

the insulating layer includes a cut or an opening, such that, before the at least two conductor wires are connected to the spiral antenna pattern, at least one of the first end and the second end of the spiral antenna pattern is exposed toward the at least two conductor wires through the cut or the opening;

the at least two conductive wires are connected to the spiral antenna pattern by the conductive material in the cut or the opening of the insulating layer; and the second insulating base portion is more flexible than the first insulating base portion; and the printed wiring board includes at least a noise filtering section and a matching section; wherein at least one of the conductor wires included in the second insulating base portion is connected to the noise filtering section or the matching section.

14. The communication terminal apparatus according to claim 13, wherein the second insulating base portion is folded back to connect the spiral antenna pattern to the noise filtering section or the matching section.

15. The communication terminal apparatus according to claim 13, wherein the second insulating base portion protrudes outward from the first insulating base portion in the plan view.

16. The communication terminal apparatus according to claim 13, wherein the insulating layer is an insulating adhesive layer.

17. The communication terminal apparatus according to claim 16, wherein the first insulating base portion further includes a first insulating base and a magnetic sheet provided on a side of a main surface of the first insulating base; and the spiral antenna pattern is provided on the main surface of the first insulating base.

18. The communication terminal apparatus according to claim 17, wherein the insulating adhesive layer has a smaller thickness than the magnetic sheet.

19. The communication terminal apparatus according to claim 17, wherein the magnetic sheet includes a cut in a portion facing the first end and the second end of the spiral antenna pattern; and the first end and the second end of the spiral antenna pattern are connected to the respective electrode portions of the at least two conductor wires by the conductive material in the cut of the magnetic sheet.

20. The communication terminal apparatus according to claim 17, wherein the insulating adhesive layer bonds the magnetic sheet to the first insulating base.

* * * * *